US009140208B1

(12) United States Patent
Shoffler

(10) Patent No.: US 9,140,208 B1
(45) Date of Patent: Sep. 22, 2015

(54) HEAT ENGINE

(71) Applicant: David Shoffler, Marion Heights, PA (US)

(72) Inventor: David Shoffler, Marion Heights, PA (US)

( * ) Notice: Subject to any disclaimer, the term of this patent is extended or adjusted under 35 U.S.C. 154(b) by 230 days.

(21) Appl. No.: 13/622,554

(22) Filed: Sep. 19, 2012

Related U.S. Application Data

(60) Provisional application No. 61/577,747, filed on Dec. 20, 2011.

(51) Int. Cl.
*F01B 29/04* (2006.01)
*F02G 1/02* (2006.01)

(52) U.S. Cl.
CPC ..... *F02G 1/02* (2013.01)

(58) Field of Classification Search
CPC ..... F02G 1/02; F02B 47/00; F01B 29/04
USPC ..... 123/46 R; 60/525, 682
See application file for complete search history.

(56) References Cited

U.S. PATENT DOCUMENTS 3,698,182 A * 10/1972 Knoos ..... 60/525
3,861,146 A * 1/1975 Lynch et al. ..... 60/524
4,008,574 A * 2/1977 Rein ..... 60/682
4,120,161 A * 10/1978 Gedeit ..... 60/682
4,894,989 A * 1/1990 Mizuno et al. ..... 60/517
5,335,497 A * 8/1994 Macomber ..... 60/519
5,755,100 A * 5/1998 Lamos ..... 60/521
6,311,491 B1 * 11/2001 Conrad ..... 60/520
7,028,476 B2 * 4/2006 Proeschel ..... 60/616
7,077,080 B2 * 7/2006 Schmuecker et al. ..... 123/46 R
7,258,086 B2 * 8/2007 Fitzgerald ..... 123/46 R
7,387,849 B2 * 6/2008 Keefer et al. ..... 429/411
7,705,479 B2 * 4/2010 Spenceley et al. ..... 290/2
8,752,375 B2 * 6/2014 Berchowitz ..... 60/520
2006/0021343 A1 * 2/2006 Maceda et al. ..... 60/520
2006/0112687 A1 * 6/2006 Clark et al. ..... 60/520
2008/0110175 A1 * 5/2008 Graham ..... 60/753
2008/0185198 A1 * 8/2008 Jones ..... 180/65.2
2009/0260355 A1 * 10/2009 Alderson et al. ..... 60/517
2011/0302902 A1 * 12/2011 Kelly et al. ..... 60/39.5

* cited by examiner

*Primary Examiner* — Kenneth Bomberg
*Assistant Examiner* — Shafiq Mian
(74) *Attorney, Agent, or Firm* — John J. Elnitski

(57) ABSTRACT

The present invention is a heat engine that has two piston assemblies and a center assembly between the piston assemblies. The heat engine uses a working fluid. The center assembly includes an outside wall and two end walls forming a sealed assembly. The center assembly includes two compression chambers internally. The piston assemblies are attached to the end walls of the center assembly in a sealed condition. The piston assemblies include a burner, piston cavity, piston with piston head and piston shaft. The piston shafts of the pistons are interconnected to each other. The burner is in contact with the piston cavities. There is also a heat exchanger connected to the center assembly and piston assemblies.

9 Claims, 24 Drawing Sheets

HEAT ENGINE

This application claims the benefit of and incorporates by reference U.S. Provisional Application No. 61/577,747 filed Dec. 20, 2011.

BACKGROUND

The present invention relates generally to heat engines, and more particularly to Sterling style heat engines.

A heat engine is a system that performs the conversion of hear or thermal energy to mechanical work. It does this by bringing a working fluid from a high temperature state to a lower temperature state. A heat "source" generates thermal energy that brings the working fluid to the high temperature state. The working fluid generates work in the body of the engine while transferring heat to the colder sink until it reaches a low temperature state. During this process some of the thermal energy is converted into work by exploiting the properties of the working fluid. The working substance can be any system with a non-zero heat capacity, but it usually is a gas or liquid. Heat engines operate by cyclic compression and expansion a working fluid at different temperature levels such that there is a net conversion of heat energy to mechanical work. A closed-cycle regenerative heat engine with a permanent working fluid is known as a Sterling engine and its inclusion of a regenerator differentiates it from other closed cycle hot air engines. The Sterling engine is noted for its high efficiency compared to steam engines, quiet operation, and the ease with which it can use almost any heat source. Like the steam engine, the Sterling engine is traditionally classified as an external combustion engine, as all heat transfers to and from the working fluid take place through a solid boundary of a heat exchanger, thus isolating the combustion process and any contaminants it may produce from the working parts of the engine. This contrasts with an internal combustion engine where heat input is by combustion of a fuel within the body of the working fluid.

In a Sterling engine, the regenerator is an internal heat exchanger and temporary heat store placed between the hot and cold spaces such that the working fluid passes through it first in one direction then the other. The design challenge for a Sterling engine regenerator is to provide sufficient heat transfer capacity without introducing too much additional internal volume or flow resistance. These inherent design conflicts are one of many factors which limit the efficiency of practical Sterling engines. Since the Sterling engine is a closed cycle, it contains a fixed mass of gas called the "working fluid", most commonly air, hydrogen or helium. In normal operation, the engine is sealed and no gas enters or leaves the engine. No valves are required, unlike other types of piston engines. The Sterling engine, like most heat engines, cycles through four main processes: cooling, compression, heating and expansion. This is accomplished by moving the gas back and forth between hot and cold heat exchangers, often with a rengenerator between the heater and cooler. The hot heat exchanger is in thermal contact with an external heat source, such as a fuel burner, and the cold heat exchanger being in thermal contact with an external heat sink, such as air fins. A change in gas temperature will cause a corresponding change in gas pressure, while the motion of the piston causes the gas to be alternately expanded and compressed.

The drawbacks to the Sterling style heat engine are first is the heat exchanger and regenerator are position with the engine making it bulky and difficult to fit in small areas.

Second is that for the size of the heat engine, there is less power than would be imaged due to the constraints of moving the working fluid.

An object of the present is to provide a heat engine that is an improvement on current designs of a Sterling type heat engine for sizing and power.

SUMMARY OF THE INVENTION

The present invention is a heat engine that has two piston assemblies and a center assembly between the piston assemblies. The heat engine uses a working fluid. The center assembly includes an outside wall and two end walls forming a sealed assembly. The center assembly includes two compression chambers internally. The piston assemblies are attached to the end walls of the center assembly in a sealed condition. The piston assemblies include a burner, piston cavity, piston with piston head and piston shaft. The piston shafts of the pistons are interconnected to each other. The burner is in contact with the piston cavities. There is also a heat exchanger connected to the center assembly and piston assemblies.

DETAILED DESCRIPTION

Figure 1:
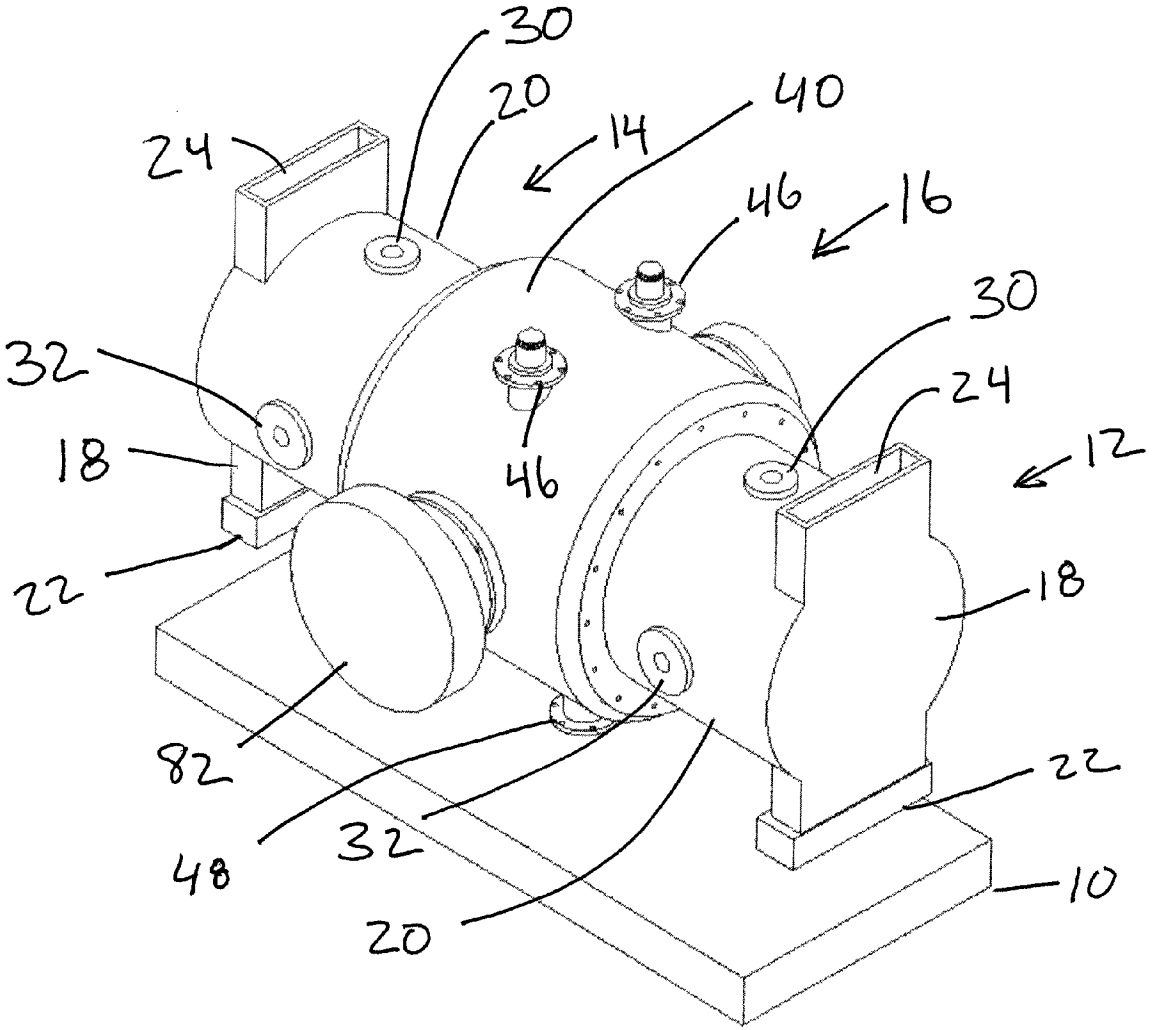
FIG. 1 is a perspective view of a heat engine according to the present invention.
Figure 2:
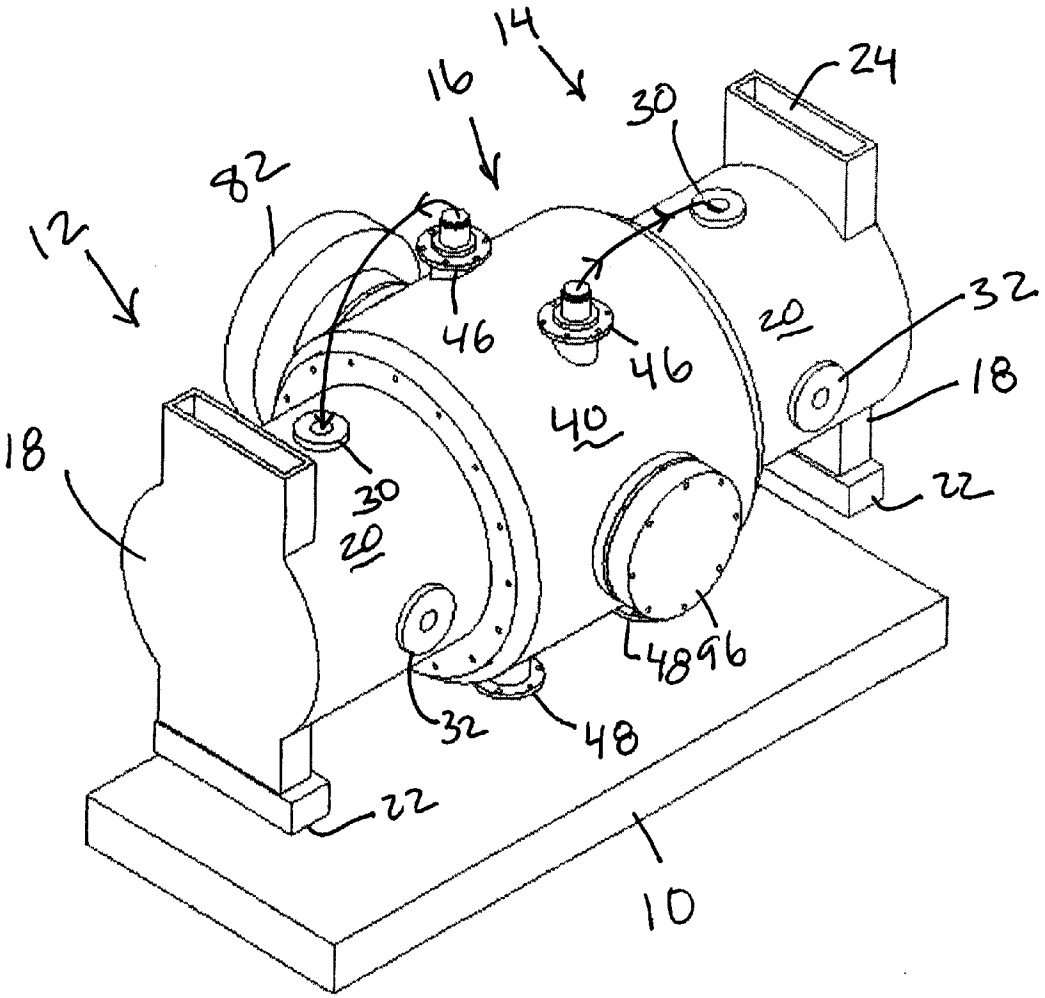
FIG. 2 is a perspective view of a heat engine according to the present invention.
Figure 3:
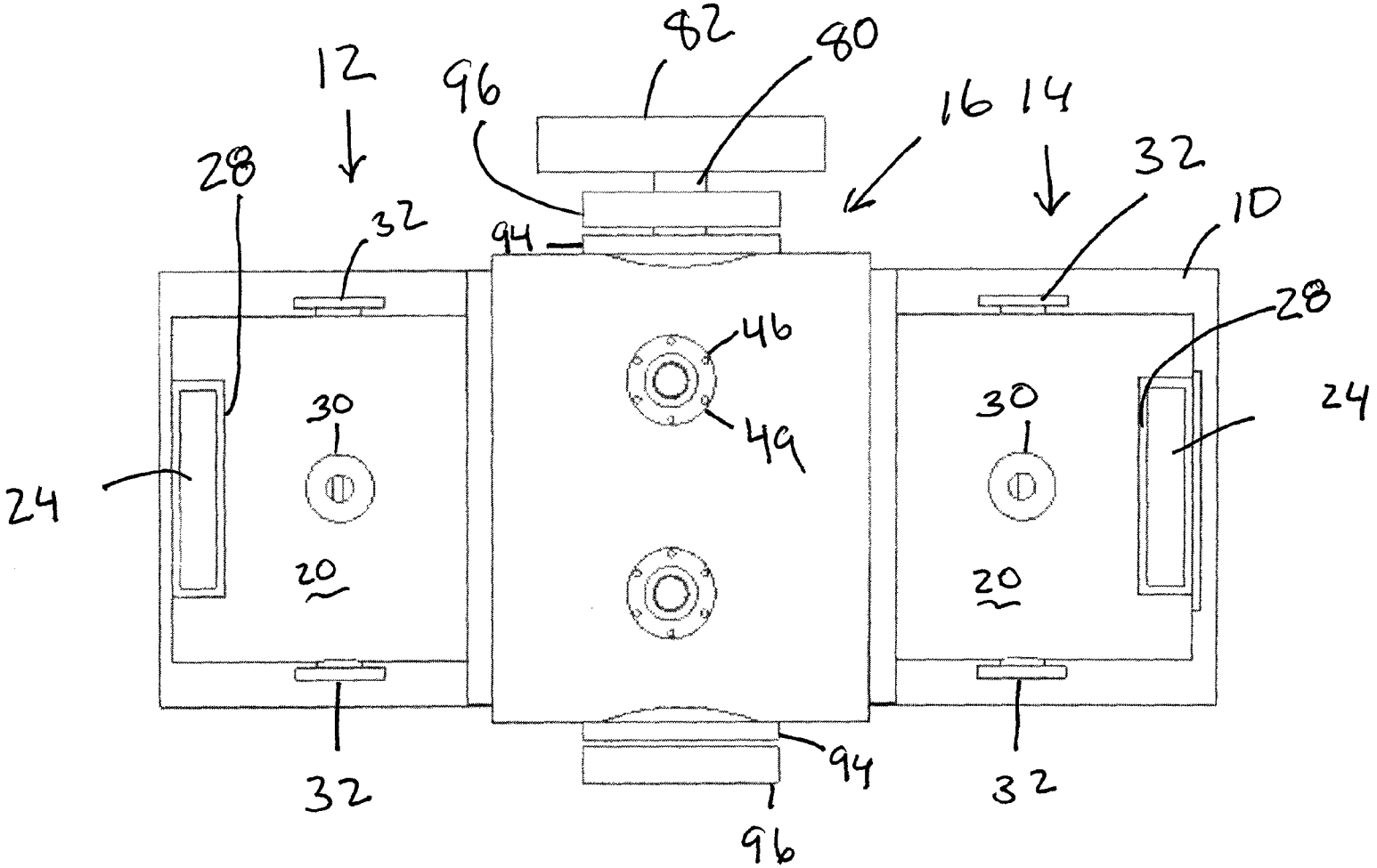
FIG. 3 is a top view of a heat engine according to the present invention.
Figure 4:
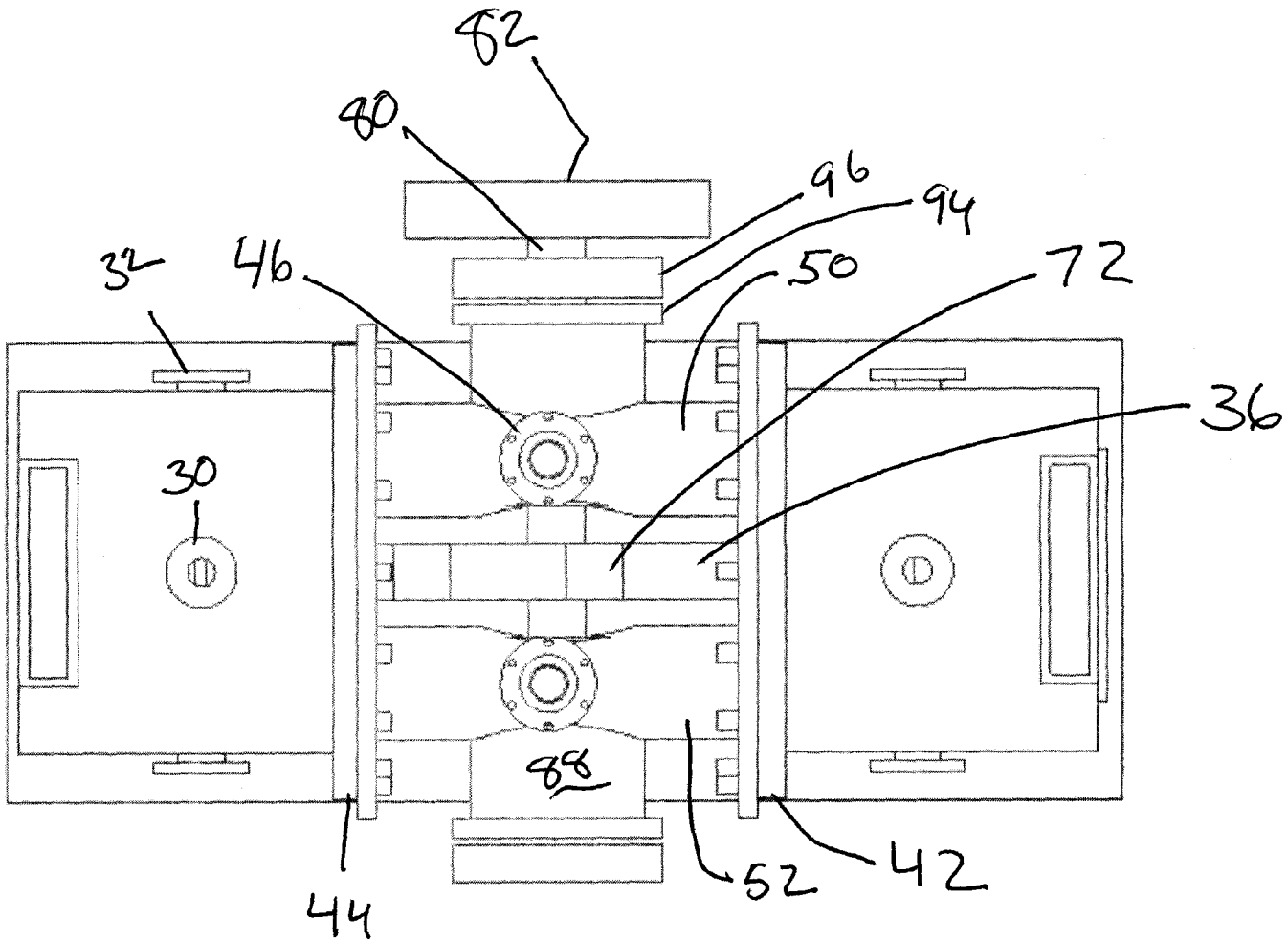
FIG. 4 is a top view of a heat engine according to the present invention.
Figure 5:
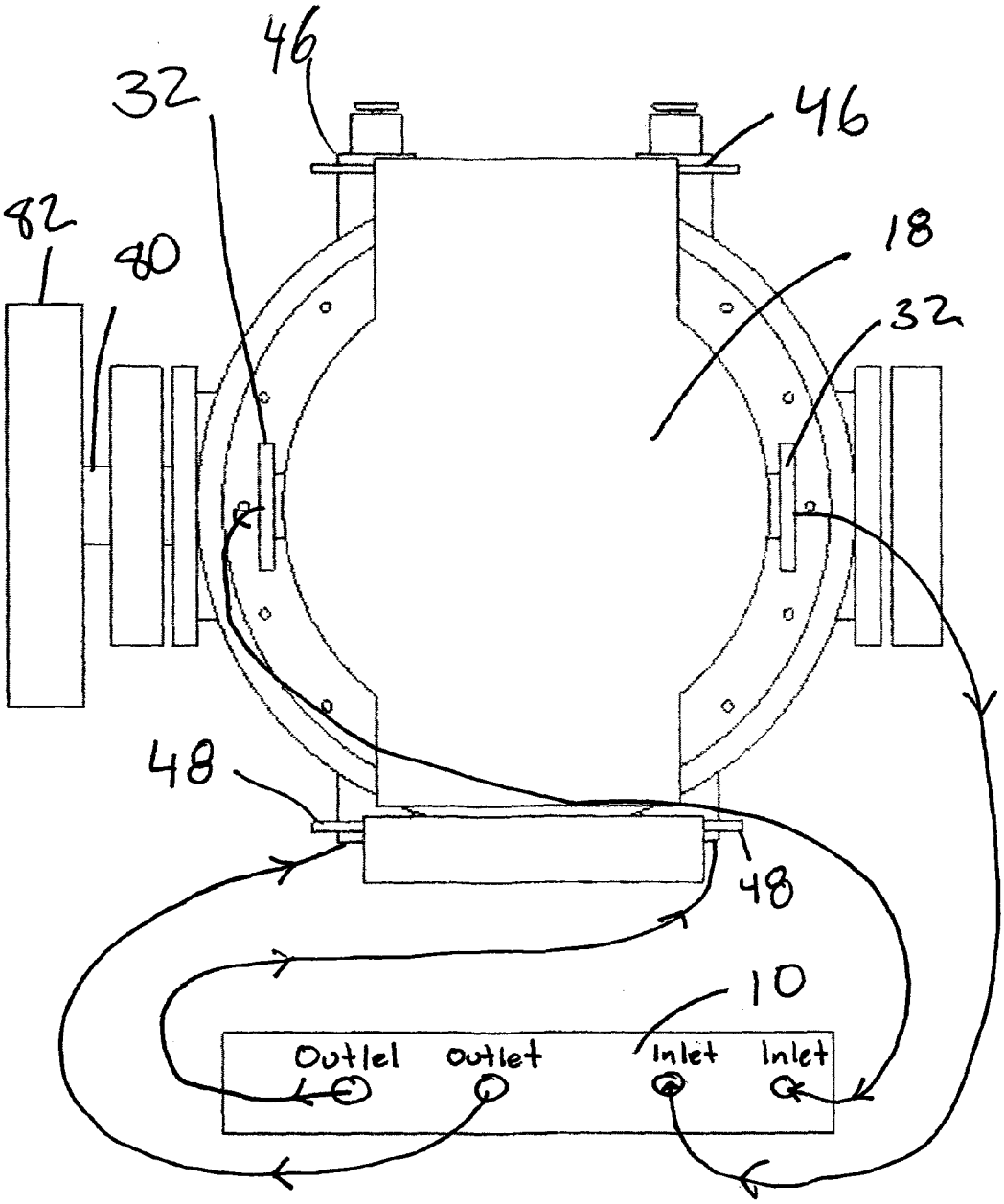
FIG. 5 is an end view of a heat engine according to the present invention.

The present invention is a heat engine, as shown in FIGS. 1-2. The heat engine provides advantages over the current Sterling type engines. The first is the heat engine does not have a regenerator so it is not restricted to constraints of current heat engine that use a regenerator. The second is a valve system for working fluid circulation that allows for building more pressure in the cylinder to produce significantly more power than any current design. The heat engine of the present invention uses a unique circulation cycle of working fluid to produce power. FIGS. 1-2 show the main assemblies of the heat engine. The main assemblies include a heat exchanger 10, first piston assembly 12, second piston assembly 14 and the center assembly 16. The heat exchanger 10 is like standard heat exchangers in that the heat exchanger 10 takes a heated fluid in a first chamber and heats another fluid in a second chamber that is next to the first chamber. Where, the first chamber and second chamber are merely separated by a wall that prevents the mixture of the fluids. The heat exchanger 10 in the present invention includes an air inlet to pull in ambient air from the surroundings of the heat engine and into the heat exchanger 10. The ambient air flows through the heat exchanger 10 to the piston assemblies 12, 14, where the heat exchanger 10 and the piston assemblies 12, 14 are connected. The heat engine of the present invention uses a working fluid to move the components of the heat engine. The working fluid moves through the heat exchanger 10 at a much higher temperature than the ambient air. The heat engine is connected to the heat exchanger 10 so that the working fluid flows through the heat exchanger 10. There are two inlets with feed two separate working fluid chambers. Each working fluid chamber has an outlet that leads back to the heat engine. The working fluid of each of the working fluid chambers are used to heat the ambient air before the ambient air enters the piston assemblies 12, 14. The working fluid is heated by burners 18 in the piston assemblies 12, 14 and the heated ambient air is used as combustion air in the burners 18.

The piston assemblies 12, 14 are shown in FIGS. 1-8. Each piston assembly includes a piston housing 20, burner 18 and a piston. The burners 18 are at the end of the piston assemblies 12, 14. Each burner 18 includes an air inlet 22 and an exhaust 24. The air inlet 22 is connected to the heat exchanger 10 to receive the heated air for use as combustion air. The heated air is combined with fuel in the burner 18 to aid in burning of the fuel in the burner 18. The waste from the burned fuel exits out the exhaust 24. The piston housing 20 includes a piston cavity 26. There is a wall 28 of the burner 18 between the burner 18 and the piston cavity 26. The piston cavity 26 contains working fluid. When the wall 28 is heated due to burning fuel, the heated wall 28 heats the working fluid in the piston cavity 26 due to heat transfer. The piston housing 20 includes one inlet port 30 that leads working fluid into the piston cavity 26. The piston housing 20 includes two outlet ports 32 that lead working fluid away from the piston cavity 26. The piston of each piston assembly 12, 14 includes a piston head 34 and piston shaft 36. The piston head 34 moves within the piston cavity 26 and includes a seal 38. The seal 38 along with the piston provides separation of working fluid on each side of the piston head 34. Each piston assemblies 12, 14 bolt to the center assembly 16, such that there a seal between the piston assemblies 12, 14 and the center assembly 16.

Figure 14:
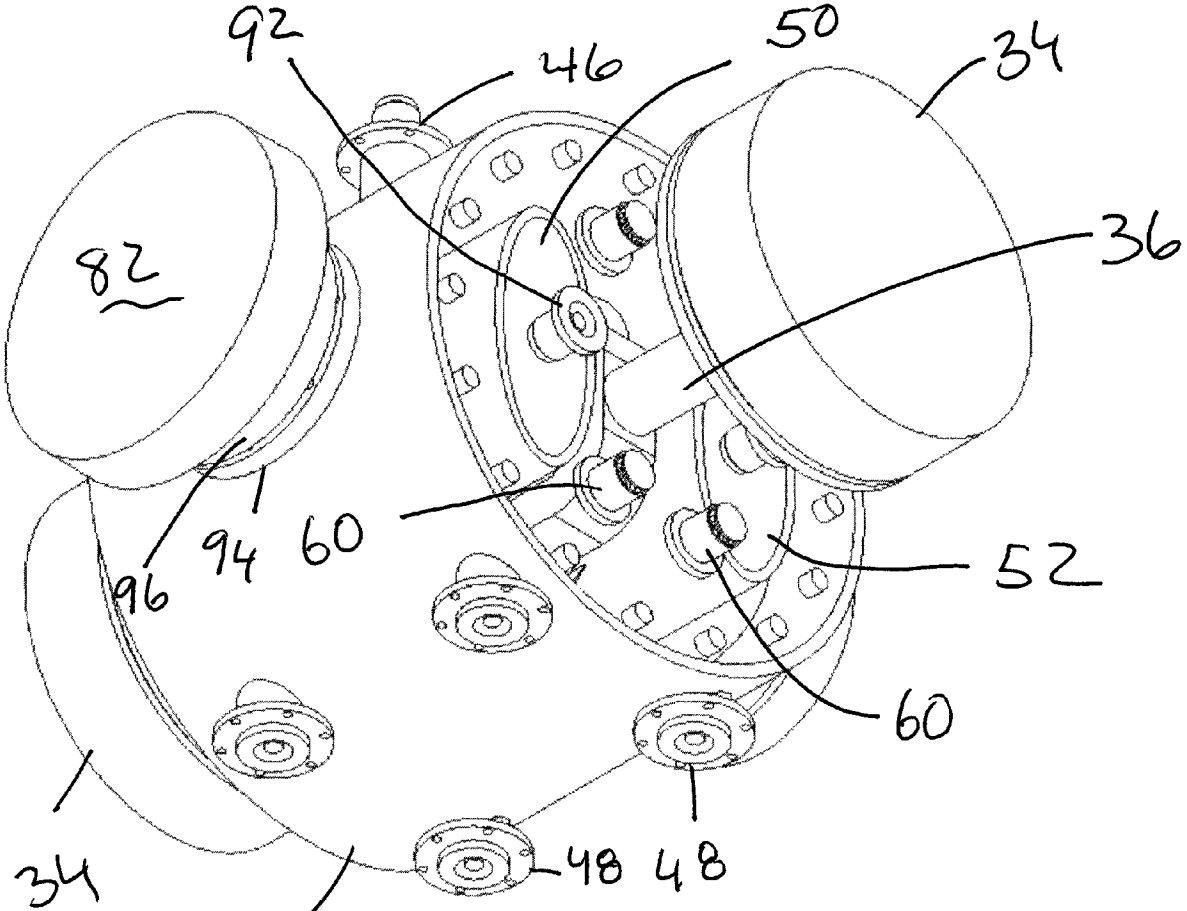
FIG. 14 is a cutaway view of a heat engine according to the present invention.
Figure 15:
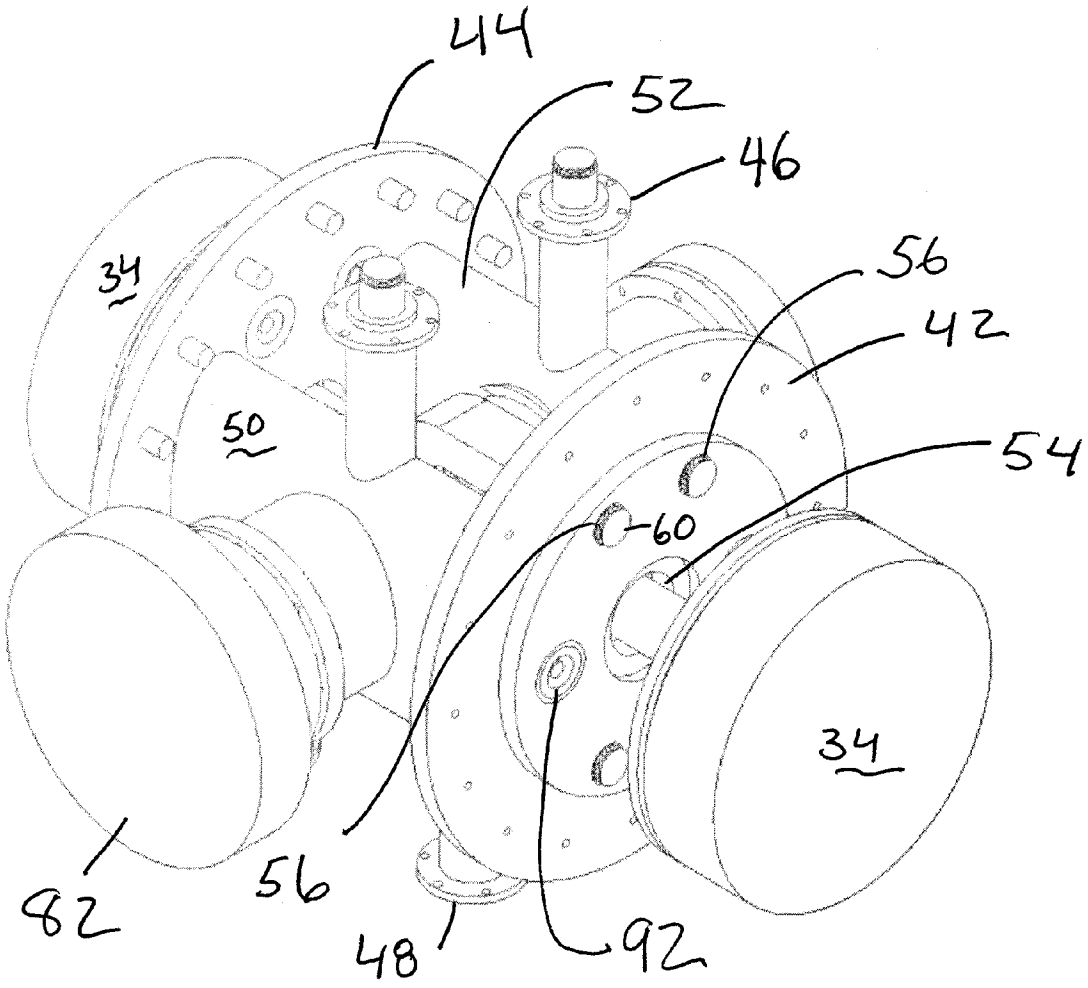
FIG. 15 is a cutaway view of a heat engine according to the present invention.
Figure 16:
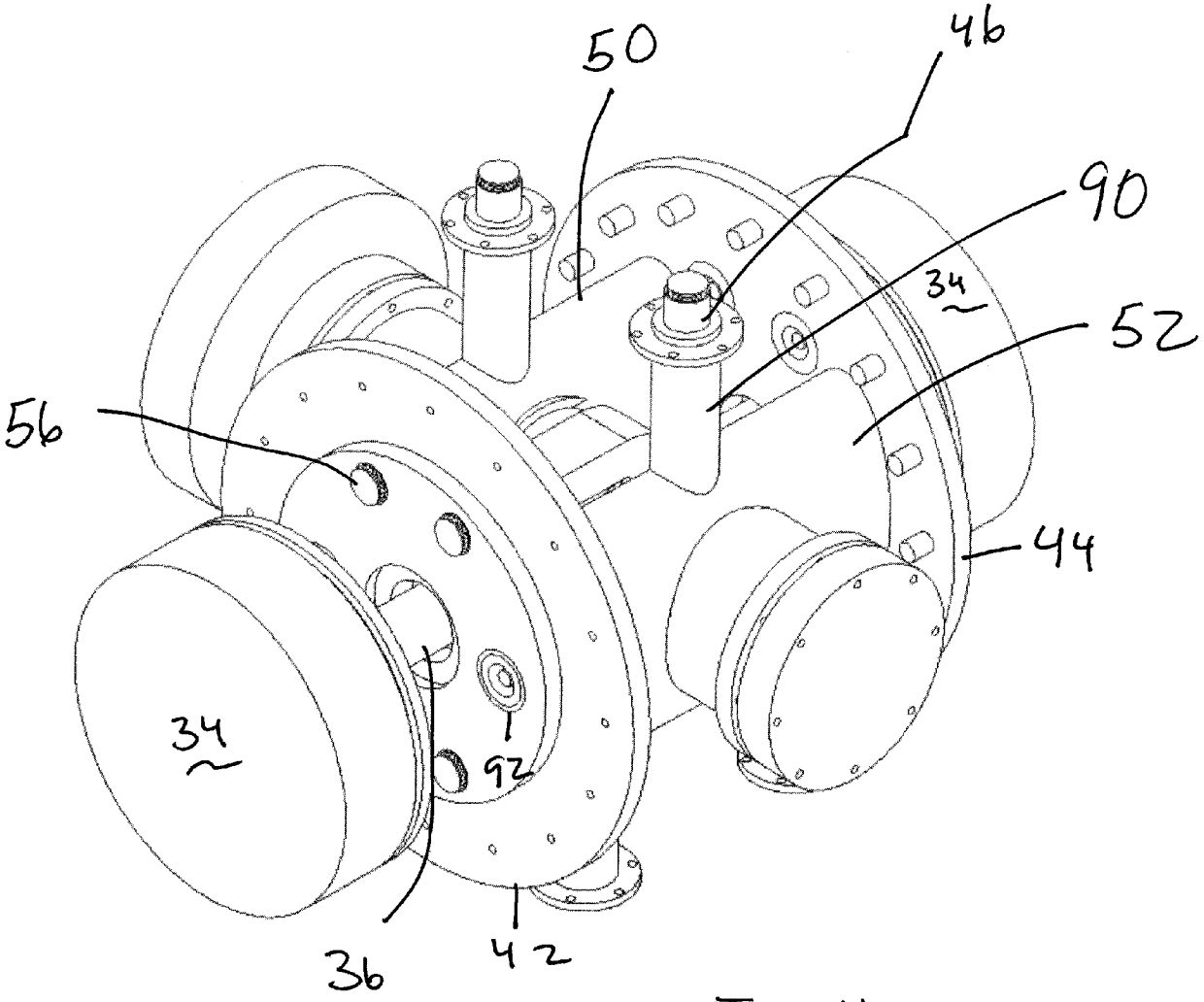
FIG. 16 is a cutaway view of a heat engine according to the present invention.
Figure 22:
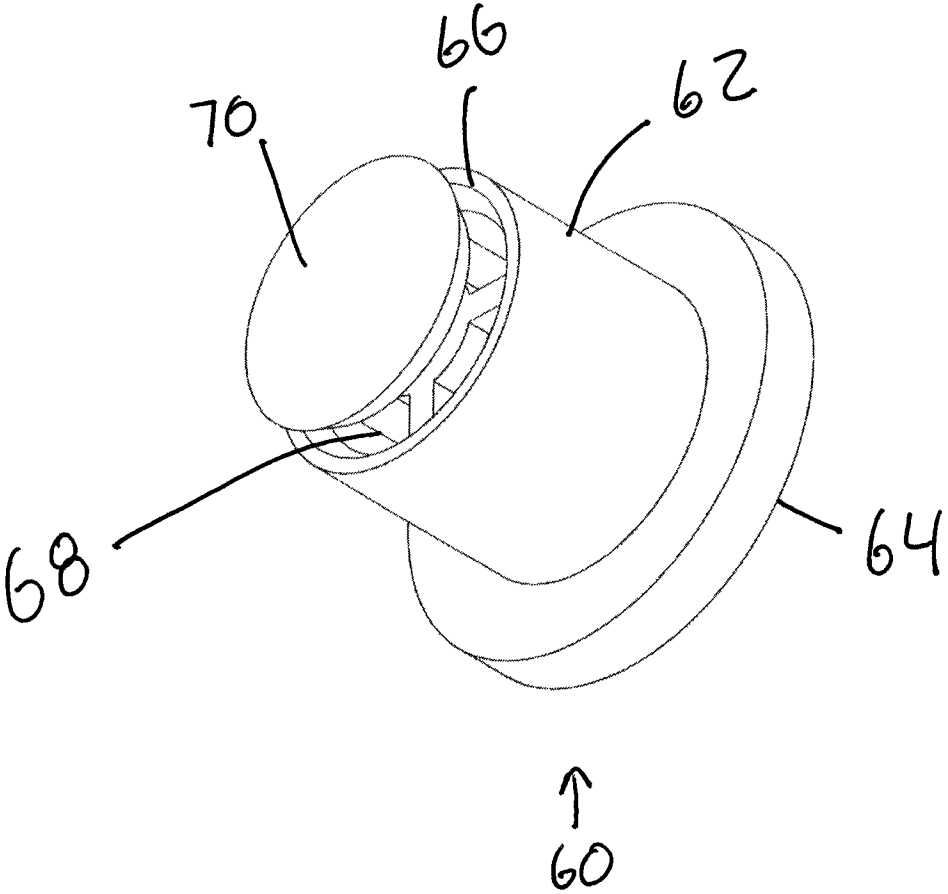
FIG. 22 is a perspective view of a one way valve according to the present invention.
Figure 23:
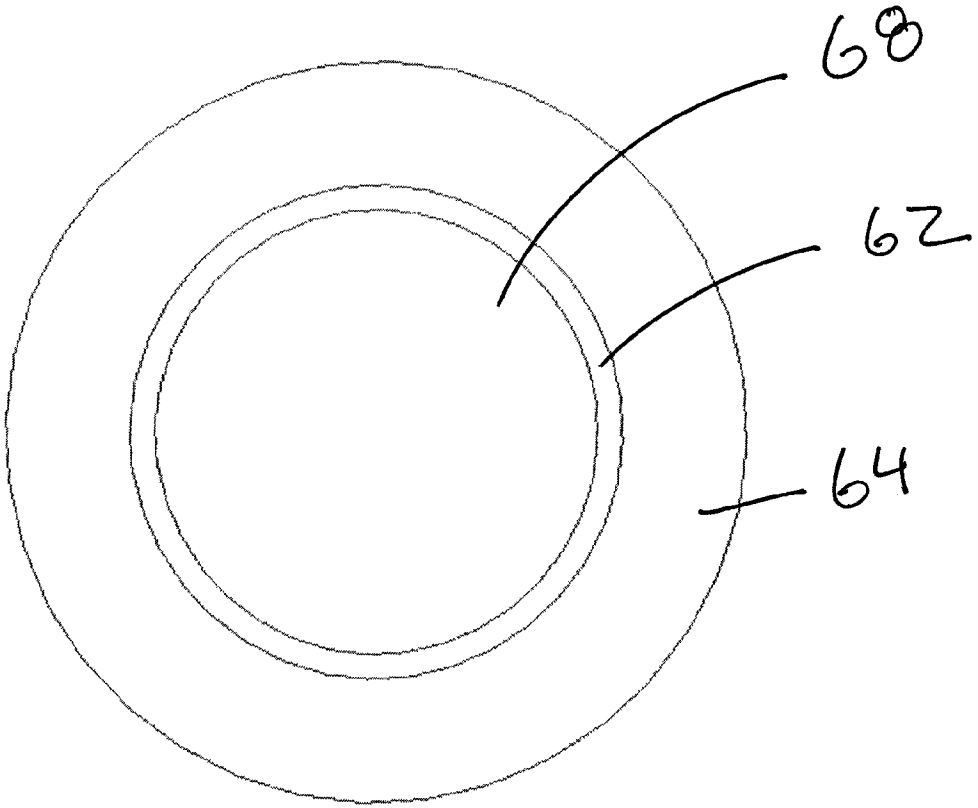
FIG. 23 is an end view of a one way valve according to the present invention.
Figure 24:
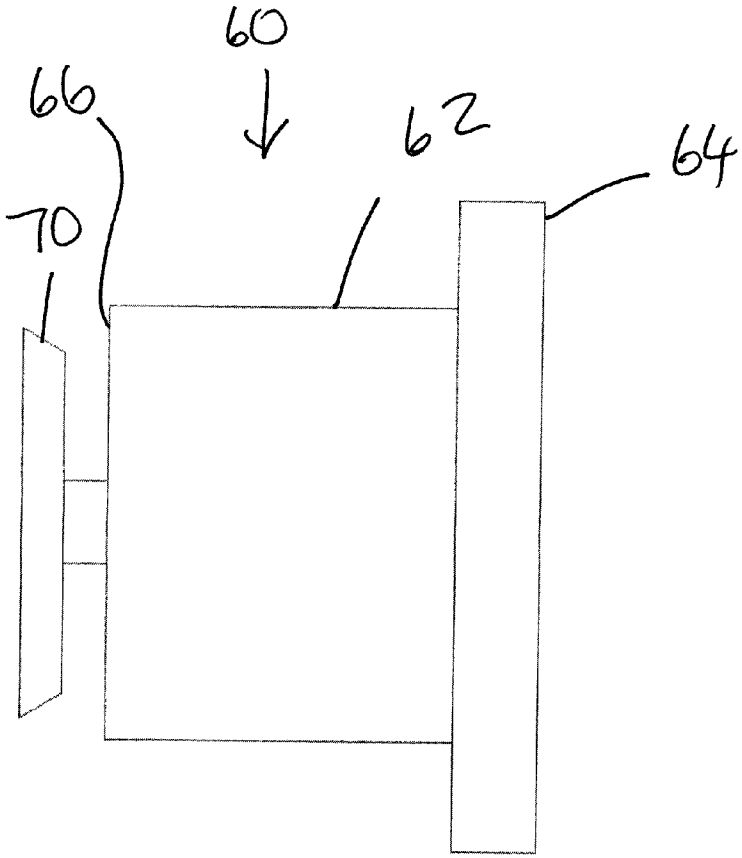
FIG. 24 is a side view of a one way valve according to the present invention.

FIGS. 1-4 and 9-16 show the center assembly 16. The center assembly 16 includes a housing with a main wall 40 a first end wall 42 and second end wall 44. The center assembly 16 acts as a reserve tank for the working fluid. The main wall 40 includes two top outlet ports 46 and four bottom inlet ports 48. The housing houses components of the center assembly 16, as well as acting as a reserve tank. The housing connects to the piston assemblies 12, 14 at the end walls 42, 44, respectively. The center assembly 16 includes a first compression chamber 50 and a second compression chamber 52 inside the housing. FIG. 14 shows the housing with the end wall 42 removed. FIGS. 15-16 show the housing with the main wall 40 removed. The end walls, 42, 44 include a piston shaft hole 54 to receive the piston shaft 36 of each piston. The piston shaft hole 54 is designed to seal about the piston shaft 36 so that no working fluid in the piston cavity 26 will mix with working fluid inside the housing of the center assembly 16. The seal in the piston shaft hole 54 allows the piston shaft 36 to move in and out of the piston shaft hole 54 in a sealed condition. The end walls 42, 44 include four end wall outlet ports 56, which are one way valves that allow working fluid to pass from the center assembly 16 and into the piston cavity 26. The end walls 42, 44 include two end wall inlet ports 58, which are one way valves that allow working fluid to pass from the piston cavity 26 and into the compression chambers 50, 52. FIGS. 22-24 show an example of a one way valve 60. The one way valve 60 only allows the working fluid to travel through the one valve 60 in one direction. The one way valve 60 includes a valve body 62, open end 64 and shut off end 66. The open end 64 is the entrance of an opening 68 the runs through the valve body 62. The shut off end 66 includes a spring loaded cap 70 attached to the valve body 62. A spring biases the cap 70 against the valve body 62 to close off the opening 68 and prevent working fluid from passing through the shut off end 62 to the open end 64. When the pressure is great enough from working fluid entering the open end 64, the working fluid will push the cap 70 away from the shut off end 66 of the valve body 62. When the cap 70 is pushed away, working fluid will flow from the open end 64, through the valve body 68 and out of the shut off end 66.

Figure 17:
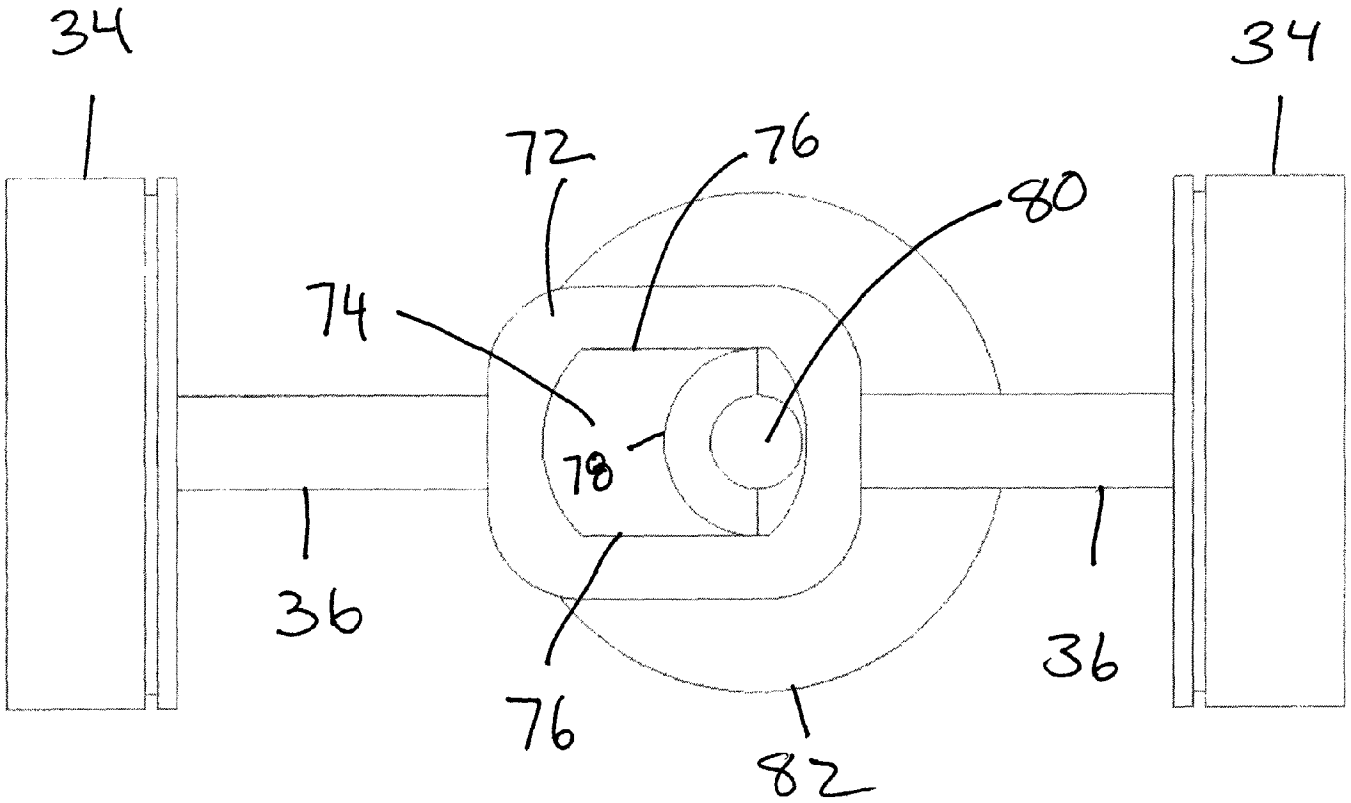
FIG. 17 is a side view of a transmission according to the present invention.
Figure 18:
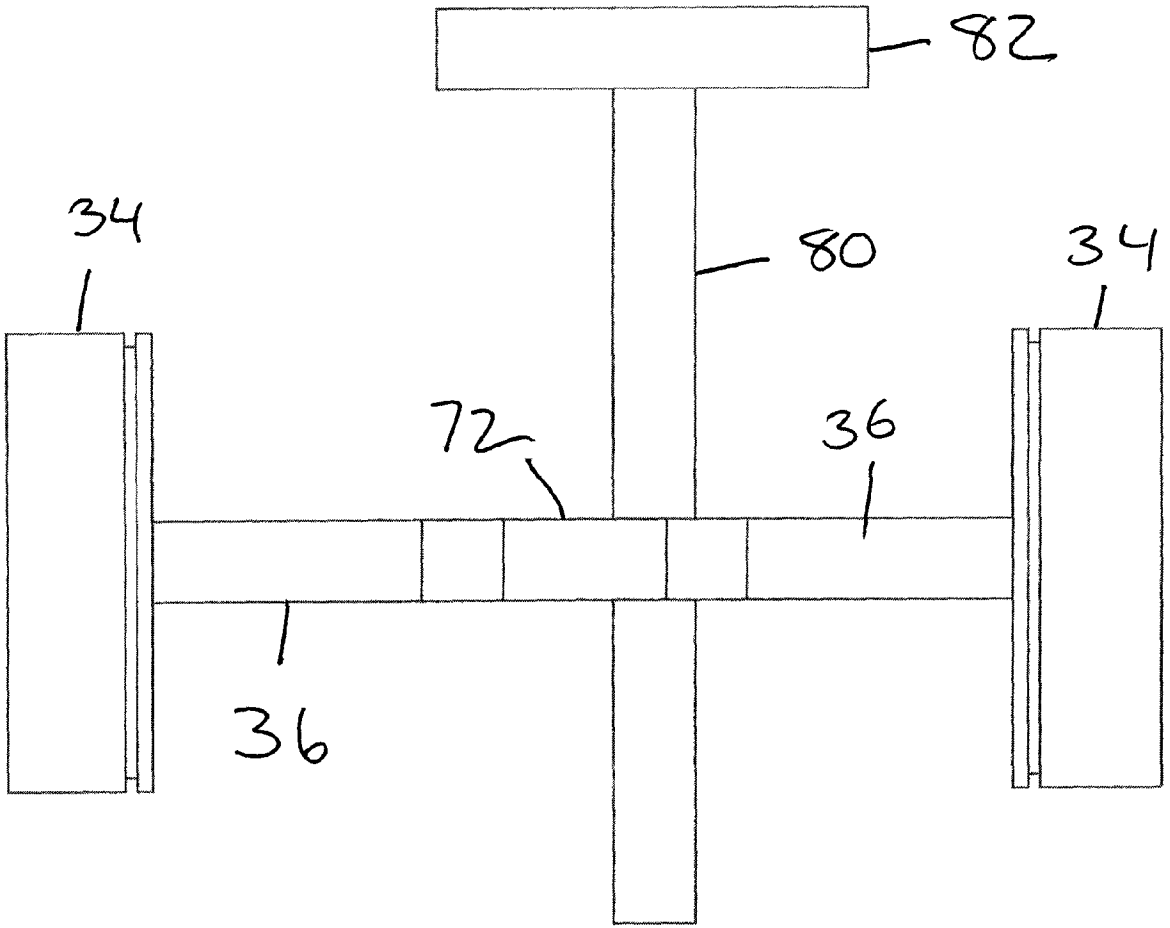
FIG. 18 is a top view of a transmission according to the present invention.

Each piston shaft 36 is connected to a slide gear 72 which interconnects the pistons, as shown in FIGS. 17-18. Therefore, when one piston moves in a direction, the other piston follows and moves in the same direction due to the pistons being interconnected by the slide gear 72. The slide gear 72 includes gear cavity 74 with gear teeth along the inner walls 76 that are parallel to the direction of movement of the piston shafts 36. Inside the gear cavity 74 is a drive shaft gear 78 of a half-moon shape. The drive shaft gear 78 rotates along the teeth of the inner walls 76. A drive shaft 80 is connected to the drive shaft gear 78 and rotates when the drive shaft gear 78 rotates. A flywheel 82 is shown connected to the drive shaft 80 to power items like a electric generator. The combination of the slide gear 72, drive shaft gear 78, drive shaft 80 and flywheel 82 acts as a transmission for transferring power as work from the heat engine to equipment to be operated. The piston shafts 36 and slide gear 72 are positioned between the two compression chambers 50, 52, as shown in FIGS. 14-16.

Figure 19:
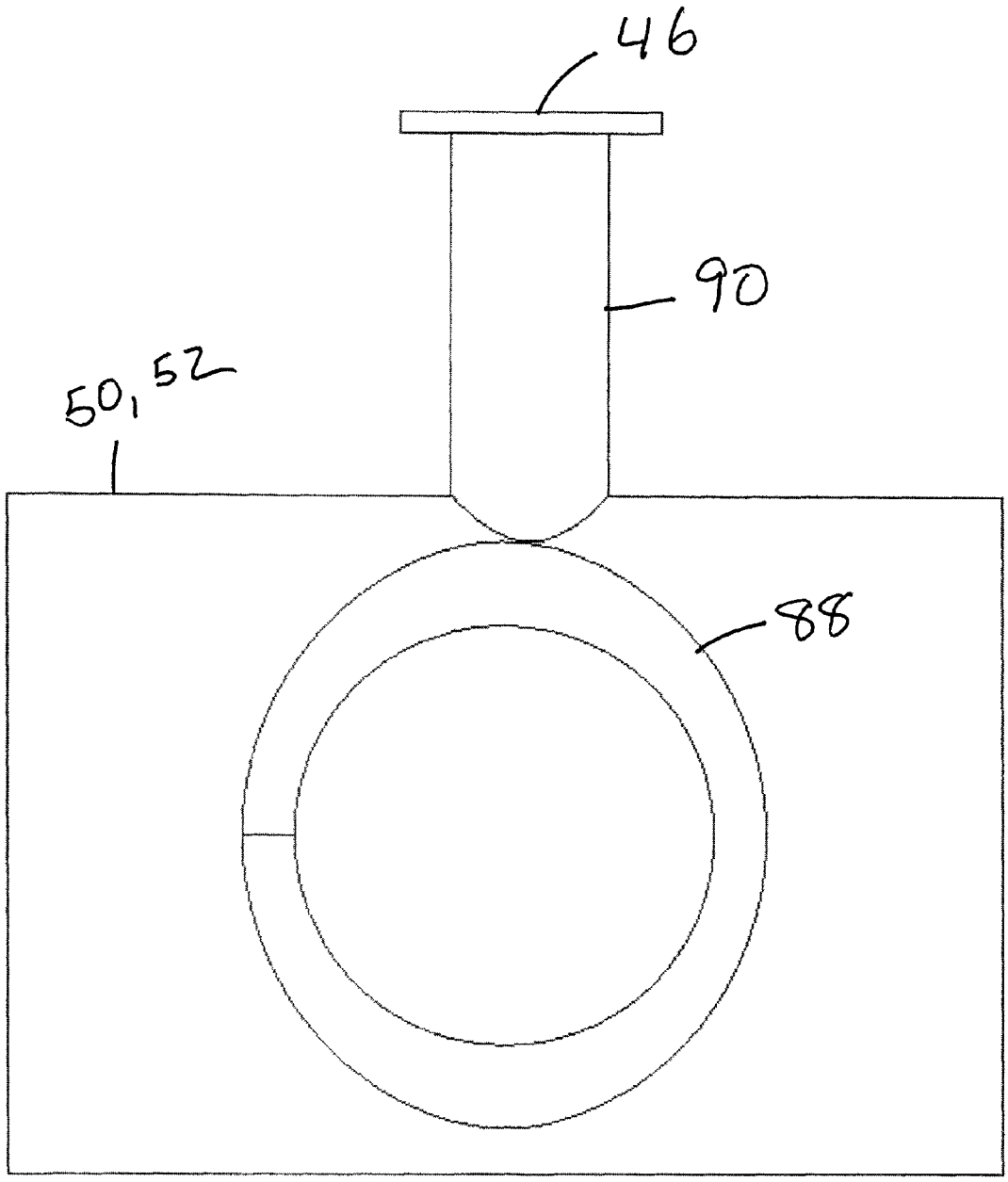
FIG. 19 is a side view of a compression chamber according to the present invention.
Figure 20:
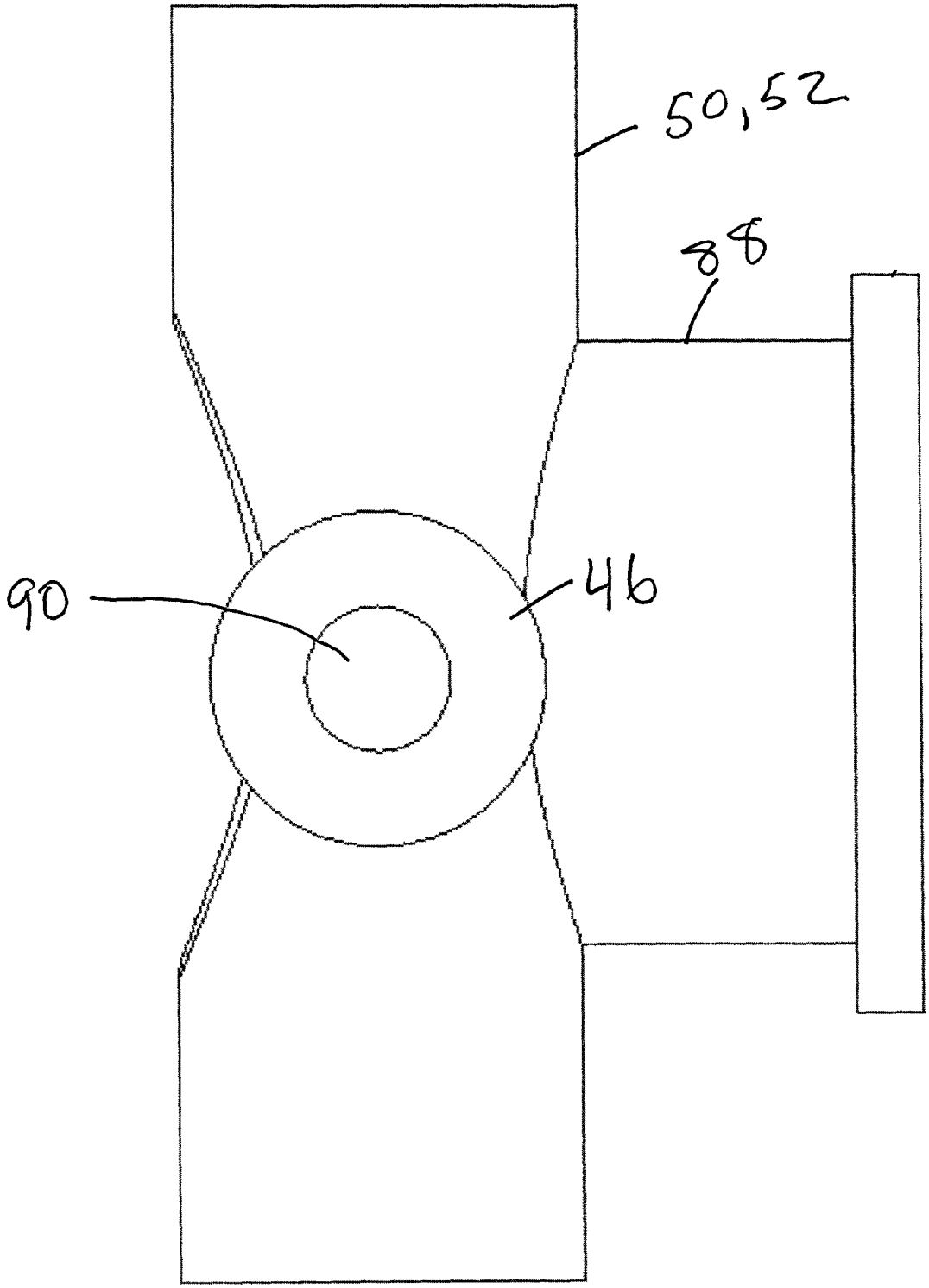
FIG. 20 is a top view of a compression chamber according to the present invention.
Figure 21:
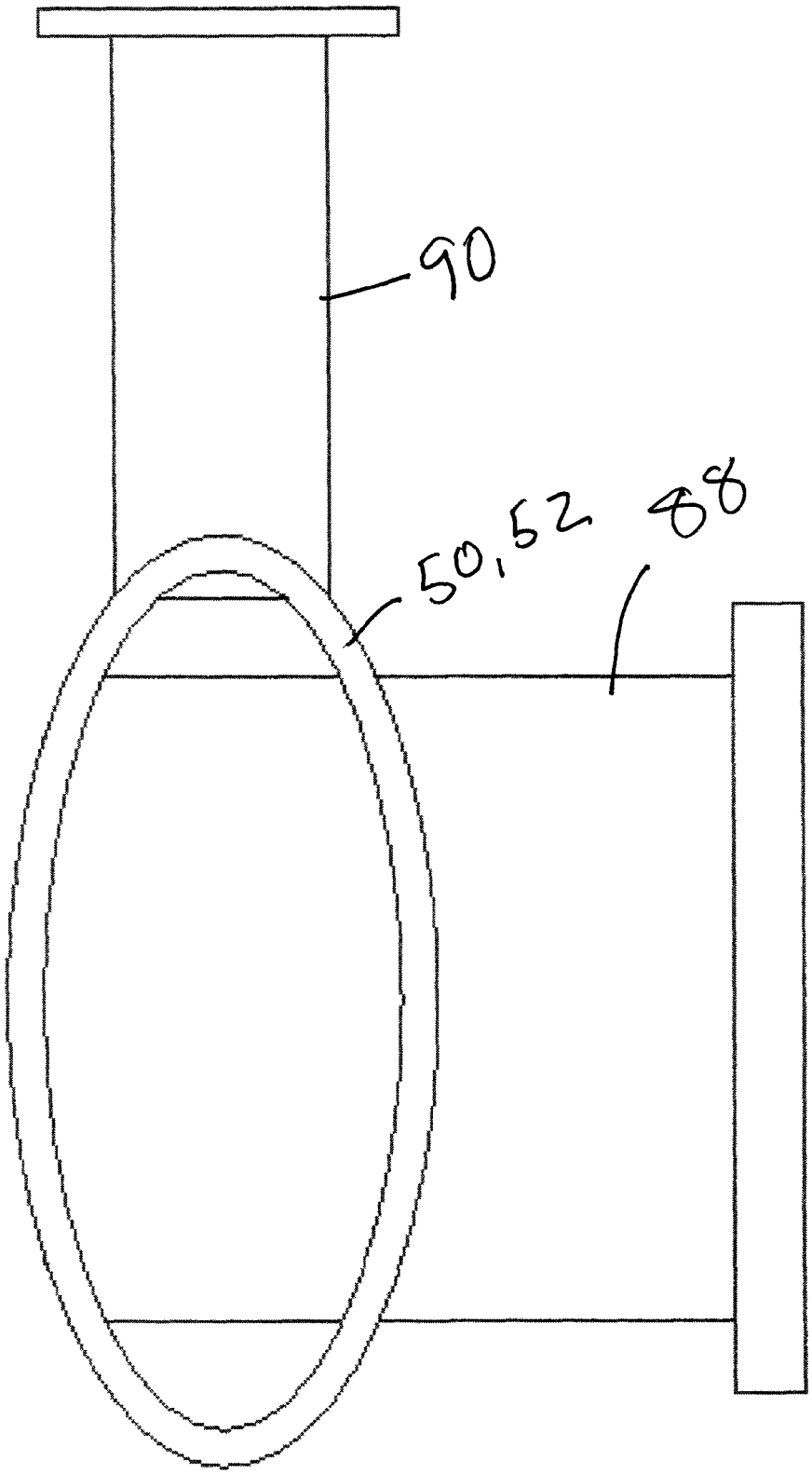
FIG. 21 is a cutaway view of a compression chamber according to the present invention.

Each compression chamber 50, 52 is shown shaped like an oval cylinder having a main wall 84 and two oval end walls 86 to provide a sealed chamber. FIG. 19 shows a side view of one of the compression chambers with a drive shaft channel 88 and an outlet port 90. The drive shaft channel 88 of the compression chamber extends from one side of the compression chamber and ends on the other side of the compression chamber. The drive shaft channel 88 provides a sealed hole through the compression chamber and allows the drive shaft 80 to extend through compression chambers 50, 52 without interfering with the compressions chambers 50, 52. FIG. 20 shows the drive shaft channel 88 and outlet port 90 from a top view of the compression chamber. FIG. 21 shows the drive shaft channel 88 and outlet port 90 from an end view of the compression chamber without the end wall of the compression chamber. FIG. 14 shows the end wall inlet ports 92 of the end wall of the center assembly 16 connected to the end wall 86 of the compression chambers 50, 52 to allow working fluid to flow from the piston assemblies 12, 14 to the compression chambers 50, 52. FIGS. 3-5 and 9-16 show seal plates 94 to seal the main wall 40 of the center assembly 16 where the drive shaft 80 exits on each side and show bearings 96 to support the drive shaft 80.

Figure 6:
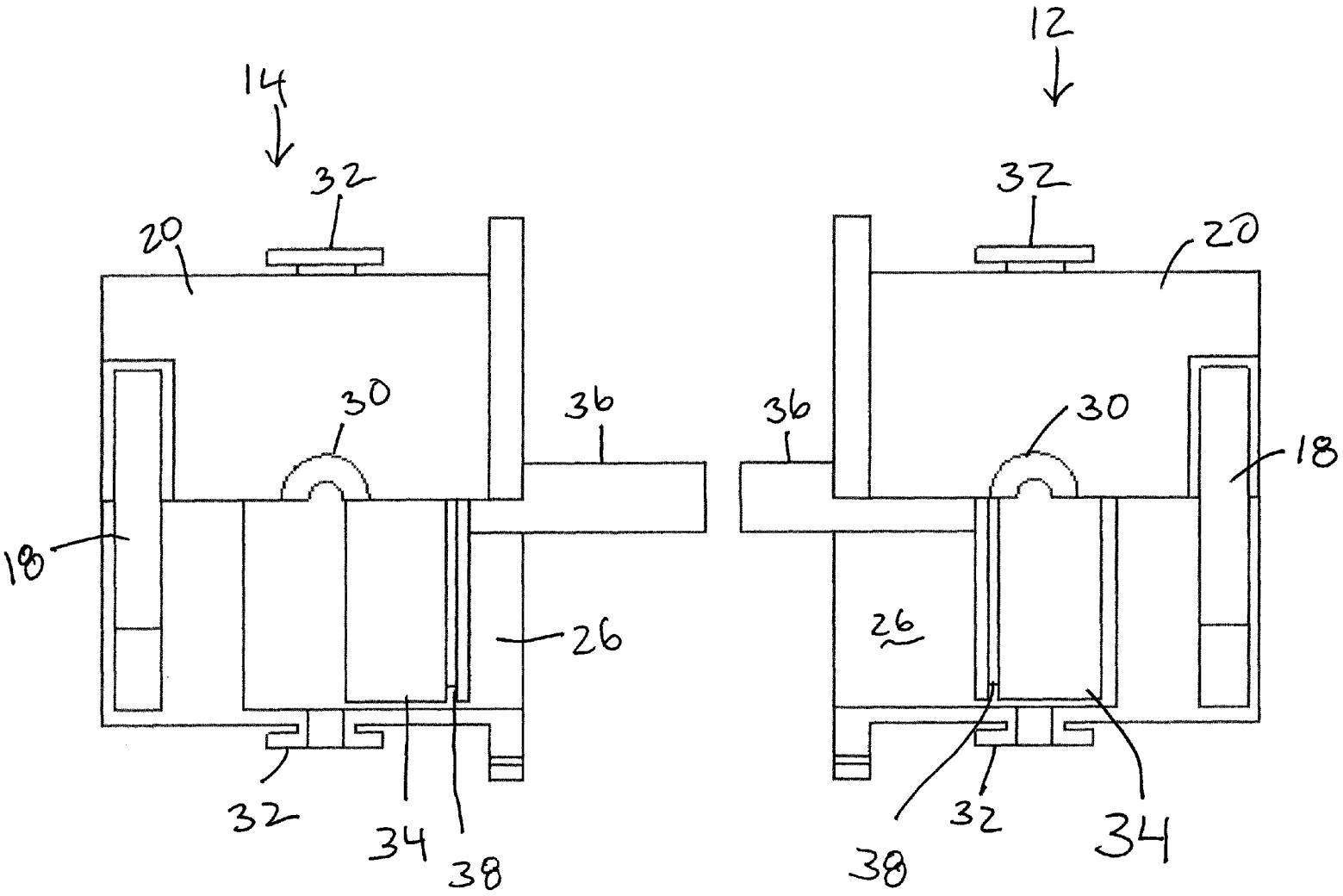
FIG. 6 is a cutaway view of a heat engine according to the present invention.

The heat engine works as follows. Piping from inlets and outlets are not shown in the figures for clarity. FIG. 6 shows the first piston assembly 12, where openings to the piston cavity 26 for both the inlet port 30 and the outlet ports 32 are blocked by the piston head 34 so that no working fluid flows through the inlet port 30 and the outlet ports 32. The inlet port 30 and the outlet ports 32 are positioned along the piston cavity 26 such that outlet ports 32 open prior to the inlet port 30 as the piston heads 34 move always from the center assembly 16 and towards the burners 18. FIG. 6 shows the second piston assembly 14, where openings to the piston cavity 26 for both the inlet port 30 and the outlet ports 32 are open to allow working fluid to flow through the inlet port 30 and the outlet ports 32, as the piston head 34 is not blocking the inlet port 30 and outlet ports 32. FIG. 6 shows piston head 34 of first piston assembly 12 closer to the burner 18 and the piston head 34 of the second piston assembly 12 is closer to the second end wall 44 of the center assembly 16. Heated combustion air flows from the heat exchanger 10 into the burner 18 of the first piston assembly 12 shown in FIG. 6. Fuel is combined with the heated combustion air and the fuel is ignited so that the fuel burns. The burning fuel heats the wall 28 of the burner 18 to a temperature range of 800 degrees Fahrenheit to 1300 degrees Fahrenheit. The waste from the burner 18 exits the exhaust 24. The heated wall 28 of the burner 18 heats the working fluid between the piston head 34 and the wall 28 to a temperature range of 800 degrees to 1300 degrees Fahrenheit for the first piston assembly 12 and the temperature could be higher depending on construction materials and fuel used. As the working fluid is heated, the molecules of the working fluid expand in size within a fixed volume between the piston head 34 and the burner 18. The expansion of the working fluid between the piston head 34 and the burner 18 causes the piston head 34 to move in the piston cavity 26 towards the center assembly 16. As piston head 34 moves due to the expansion of the working fluid between the piston head 34 and the burner 18, the piston head 34 of the second piston assembly 14 moves away from the center assembly 16 and towards the burner 18 of second piston assembly 14. The piston head 34 of the second piston assembly 14 moves due to the movement of the slide gear 72 that moves when pushed by the piston shaft 36 of the piston of the first piston assembly 12. Movement of the slide gear 72 causes the flywheel 82 to rotate. As the piston head 34 moves due to the expansion of the working fluid between the piston head 34 and the burner 18 in the first piston assembly 12, the working fluid between the end wall 42 of the center assembly 16 and the piston head 34 is compressed in the first piston assembly 12. The compressed working fluid between the end wall 42 of the center assembly 16 and the piston head 34 is forced by the piston head 34 through the one way valves of the end wall inlet ports 58 which lead into the compression chambers 50, 52. The outlet port 90 of the first compression chamber 50 is connected to the top inlet port 30 of first piston assembly 12, while the other outlet port 90 of the second compression chamber 52 is connected to the top inlet port 30 of the second piston assembly 14. So, when the compressed working fluid is forced into the compression chambers 50, 52, the second compression chamber 52 allows working fluid to flow from the second compression chamber 52 into the top inlet port 30 of the second piston assembly 14 until the piston head 34 in second piston assembly 14 closes off the inlet port 30. As the piston head in the second piston assembly 14 moves towards the burner 18 due to movement of piston head in the first piston assembly 12, the piston head 34 in the second piston assembly 14 pulls working fluid from the center assembly 16 through the one way valves of the four end wall outlet ports 52 located on the second end wall 44 of the center assembly 16. As working fluid is pulled from the center assembly 16, it is replaced by working fluid from the outlets of the working fluid chambers of the heat exchanger 10 that are connected to the bottom inlet ports 48 of the main wall 40 of the center assembly 16. At the same time, working fluid exits the outlet ports 32 of the piston housing 20 of the second piston assembly 14 which leads to one of the inlets of one of the working fluid chambers of the heat exchanger 10.

Figure 7:
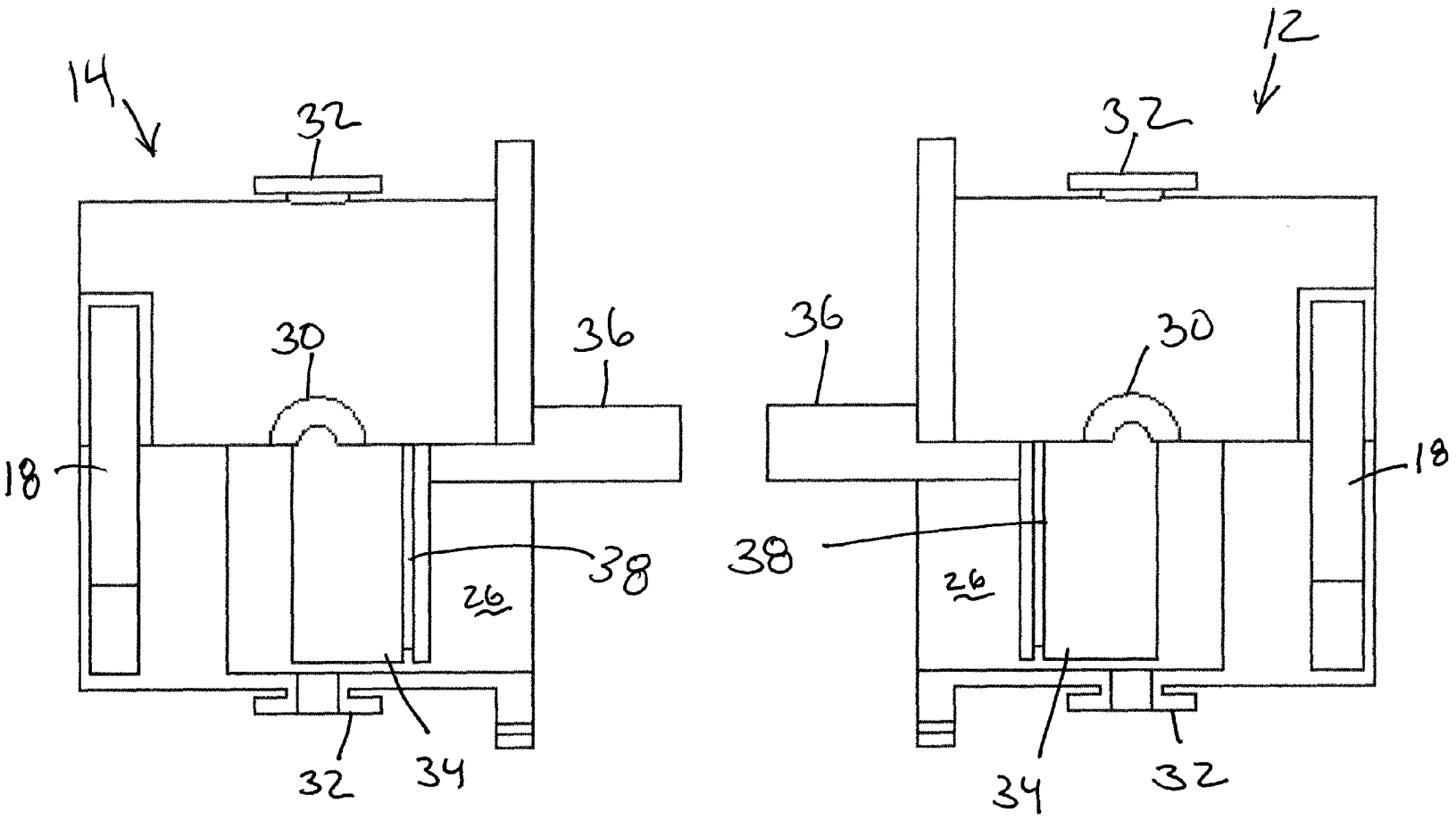
FIG. 7 is a cutaway view of a heat engine according to the present invention.
Figure 8:
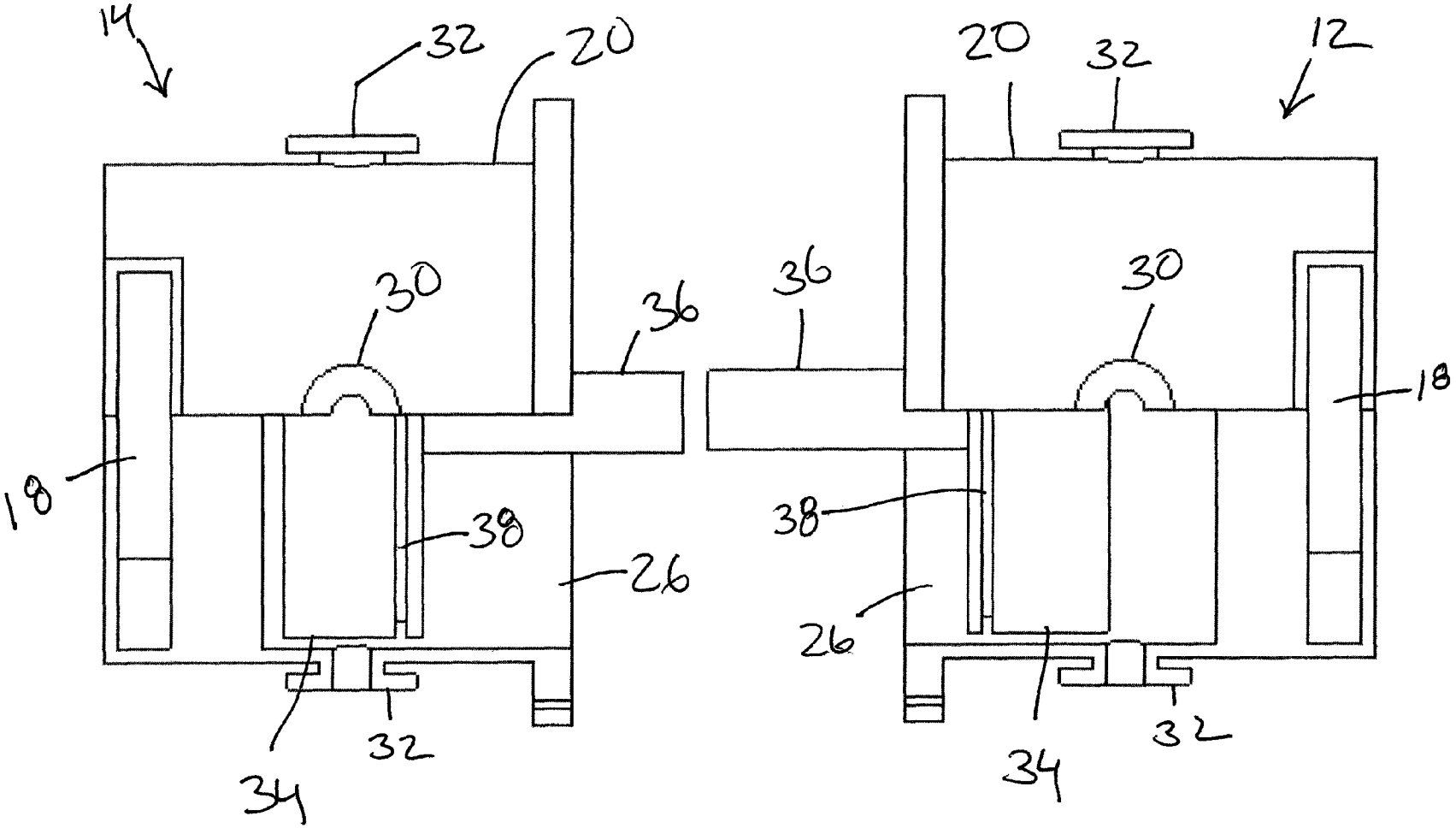
FIG. 8 is a cutaway view of a heat engine according to the present invention.
Figure 9:
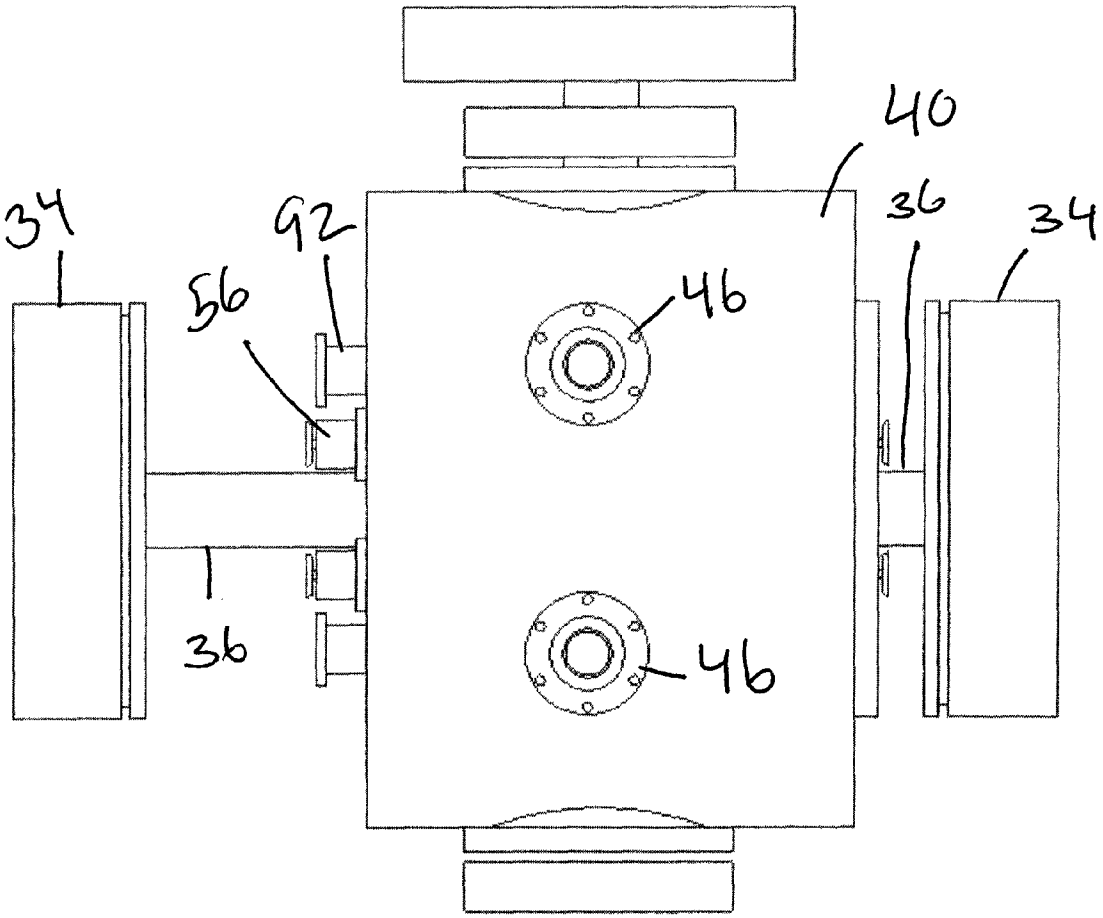
FIG. 9 is a cutaway view of a heat engine according to the present invention.
Figure 10:
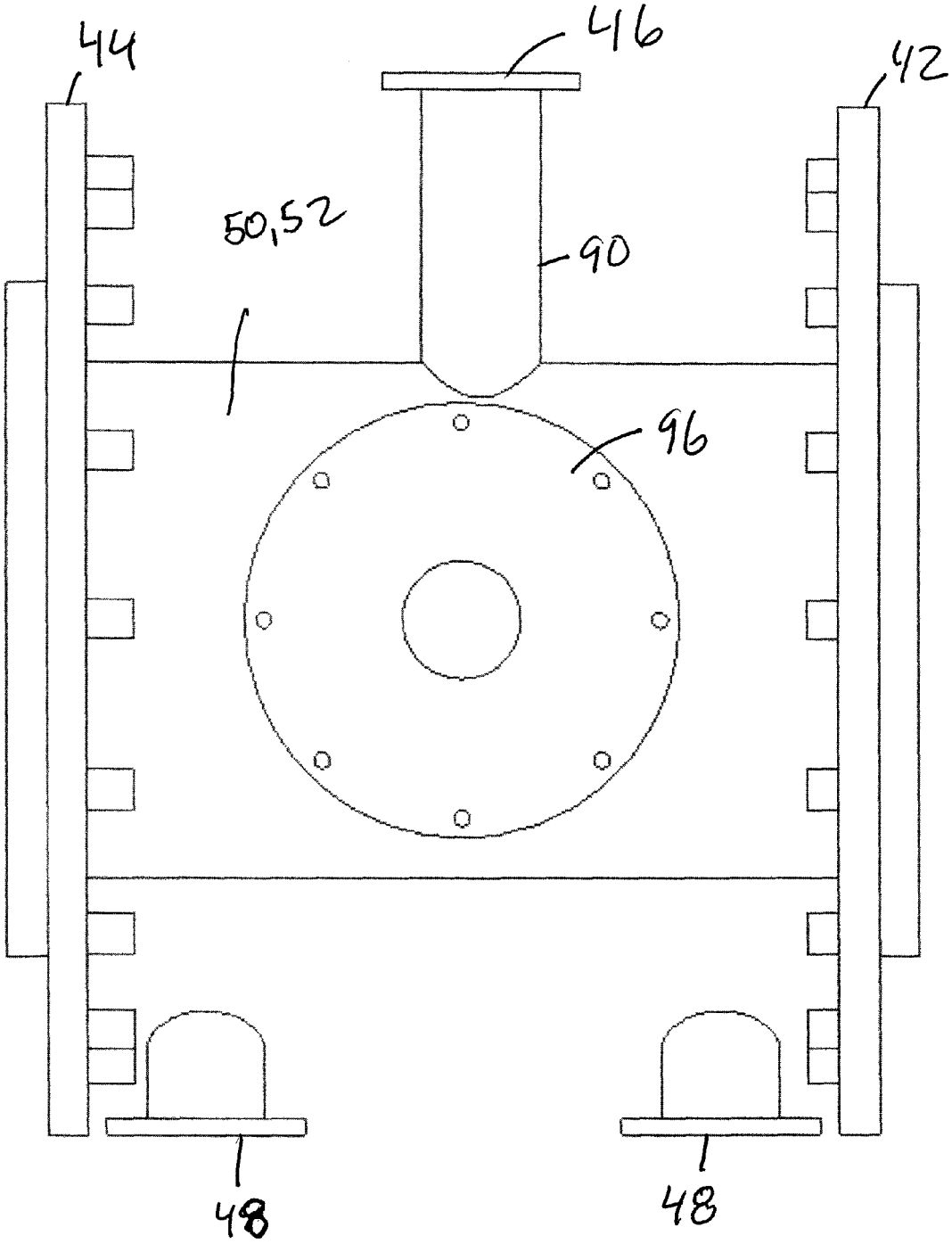
FIG. 10 is a cutaway view of a heat engine according to the present invention.
Figure 11:
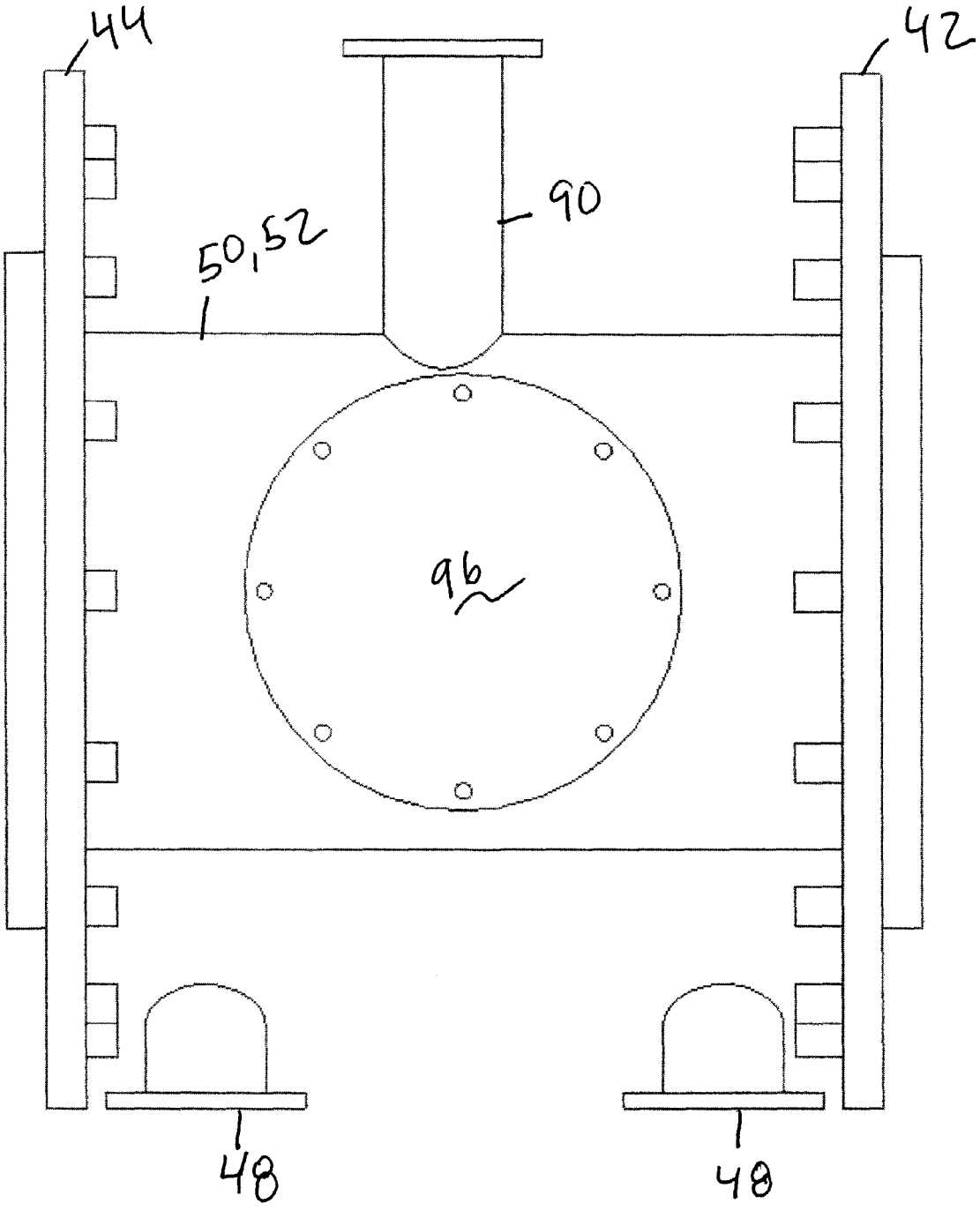
FIG. 11 is a cutaway view of a heat engine according to the present invention.
Figure 12:
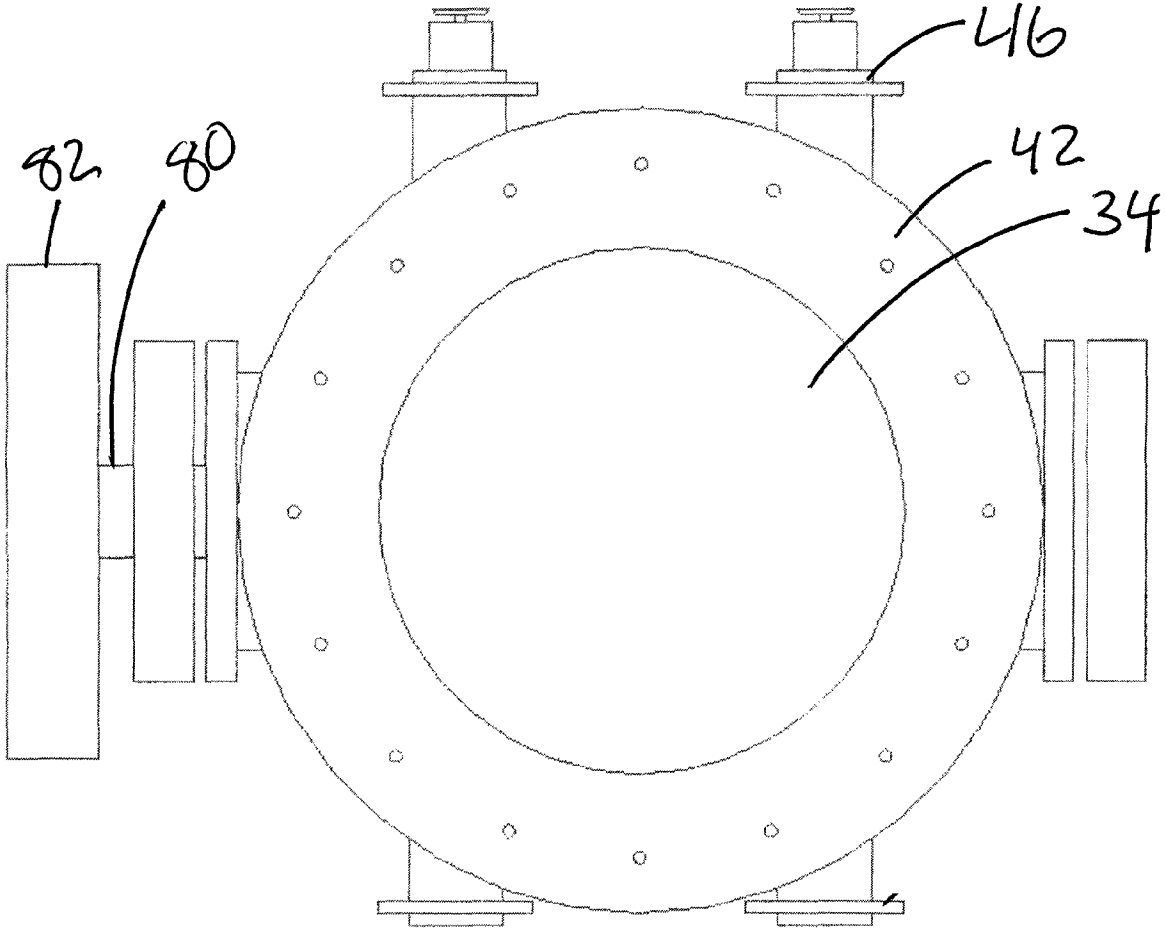
FIG. 12 is a cutaway view of a heat engine according to the present invention.
Figure 13:
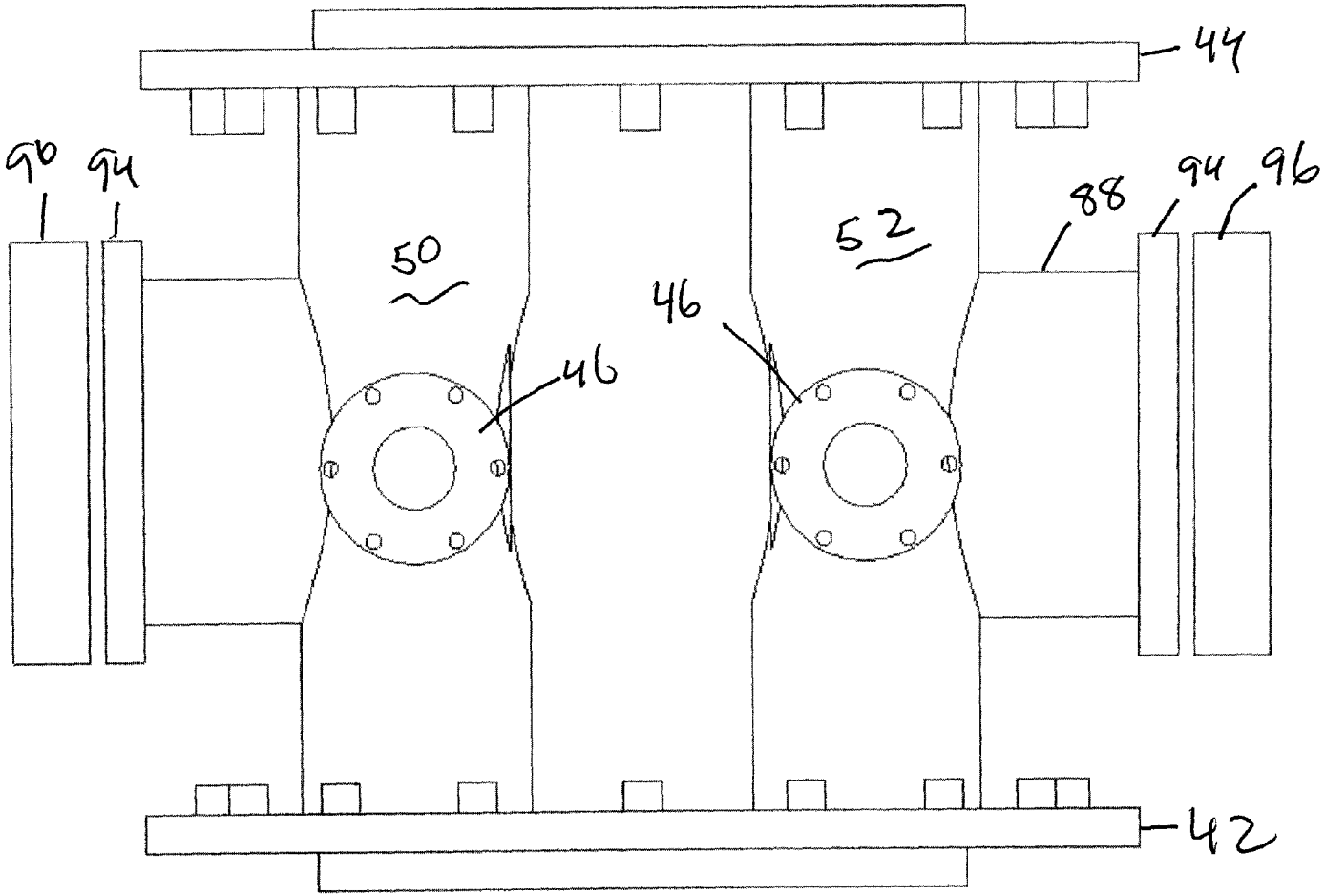
FIG. 13 is a cutaway view of a heat engine according to the present invention.

FIG. 7 shows the continued movement of the piston head of the first piston assembly 12 towards the center assembly 16. FIG. 7 shows all of the ports on the housings 20 of both piston assemblies 12, 14 closed off by the piston heads 34. In FIG. 7, compressed working fluid is still moving into the compression chambers 50, 52 from the first piston assembly 12 and working fluid is still being drawn from the housing of the center assembly 16 into the piston cavity 26 of the second piston assembly 14. FIG. 8 shows when movement of the piston head 34 of the first piston assembly 12 towards the center assembly 16 is completed. In FIG. 8, the outlet ports 32 of the housing 20 of the first piston assembly 12 are open and allow working fluid to move to the inlet of the heat exchanger 10. In FIG. 8, inlet port 30 of the housing 20 of the first piston assembly 12 is open and allows working fluid to move from the top outlet port 90 of the first compression chamber 50 into the inlet port 30 of the first piston assembly 12. In FIG. 8, the piston head 34 of the second piston assembly 14 has moved all the way towards the burner 18 of the second piston assembly 14. In FIG. 9, the inlet port 30 and outlet ports 32 of the second piston assembly 14 are blocked by the piston head 34. Once the working fluid between the piston head 34 and the wall 28 of the burner 18 of the second piston assembly 14 has been heated enough, the process will move in the reverse direction moving the slide gear 72 towards the first piston assembly 12. The movement of the slide gear 72 back and forth produces the motion on the drive shaft 80 to operate equipment like electrical generators. Current sizing of the heat engine of the present invention includes six inch diameter piston heads and one inch diameter piping between the ports. Working fluid can be air, hydrogen, helium, nitrogen or other gases.

The path of the working fluid through the present invention is a unique way to circulate the working fluid through the heat engine as compared Sterling type heat engines. The circulation of the working fluid starts by being heated by a burner that is part of the piston assembly, therefore having direct heat exchange with the working fluid in the piston cavity. The piping between inlets and outlets for the working fluid is not shown in the figures for clarity. When the piston moves toward the center assembly due to the expansion of the heated working fluid, the heated working fluid flows out the outlets of the piston housing and into the heat exchanger that is outside of the main components of the heat engine. This allows the main components of the heat engine to be smaller unit and the heat exchanger to be located in a different location from the main components of the heat engine. The working fluid flows through the heat exchanger and is cooled while heating the ambient air to be used as combustion air for the burners. Using preheated air increases the efficiency of the burners. The working fluid then flows from the heat exchanger into the center assembly and later is pulled into the piston cavity of the other piston in the area between the piston and the center assembly. When the other piston moves towards the center assembly, the fluid is forced into the compression chambers. Each of the compression chambers has the outlet port connected to one of the inlet ports of the piston housings. When the inlet port of the piston housing opens, fluid from the compression chamber flows into the piston cavity between the piston head and the burner. This same cycle happens with the working fluid that starts by being heated at the burner of the other piston assembly.

A critical part of the cycle of Sterling type heat engines is the swept volume of working fluid between the hot and cold cylinder. The heat engine of the present invention does not have that same requirement because the valve system of inlet and outlet ports causes working fluid to flow in a circular cycle through the heat engine and not a back and forth cycle used by the Sterling type heat engines. Compression of the working fluid in a Sterling type cycle allows for working fluid to escape from the cylinder through the connecting tube that runs back to the cold cylinder, which does not happen in the heat engine of the present invention. The Sterling type cycle uses a regenerator to pre-heat the working fluid before entering the piston chamber thus starting the expansion cycle before compression, thus allowing for less expansion after heating the working fluid to operating temperature. The heat engine of the present invention introduces cooler working fluid into the piston cavity before heating, which allows for a greater density of working fluid to enter the piston cavity. This is because the working fluid circulation cycle of the present invention has not allowed the working fluid expand before compression starts and because the one-way valves of the ports closes off the escape of working fluid to allow more working fluid to be compressed. The compression of more working fluid during the working fluid circulation cycle produces more power to do work. The Sterling type cycle makes use of a regenerator to pre-heat working fluid, where the present invention does not have a regenerator. The heat engine of the present invention is more efficient than the Sterling type because combustion gas used in the burner is pre-heated causing less fuel to be used to achieve the same temperature to heat the working fluid.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof

I claim:

1. A heat engine using a working fluid comprising:

a center assembly having a first compression chamber and second compression chamber internally, said center assembly having a main wall, a first end wall, and a second end wall sealing said center assembly;

a first piston assembly seal-ably attached to said first end wall of said center assembly, a second piston assembly seal-ably attached to said second end wall of said center assembly, said first and second piston assemblies each including a burner, piston cavity, piston with piston head and piston shaft, said piston shaft of said first piston assembly interconnected to said piston shaft of said second piston assembly, said burners in contact with said respective piston cavities to provide heat to the working fluid in said respective piston cavities;

a heat exchanger connected to said center assembly by a passage to direct the working fluid via said passage to said center assembly, said heat exchanger connected to said first piston assembly and said second piston assembly to receive the working fluid from said first piston assembly and said second piston assembly, said heat exchanger connected to said burner to direct heated gas to said respective burners for combustion of said heated gas;

wherein said first piston assembly includes an inlet port connected to an outlet port of said first compression chamber; wherein said second piston assembly includes an inlet port connected to an outlet port of said second compression chamber; wherein said first piston assembly includes at least one outlet port connected to a first inlet of said heat exchanger; wherein said second piston assembly includes at least one outlet port connected to a second inlet of said heat exchanger; wherein said heat exchanger includes a first outlet connected to said center assembly and a second outlet connected to said center assembly; wherein said center assembly includes at least one outlet port on each of said first end wall and said second end wall which lead from inside of said center assembly to said respective piston cavities of said first piston assembly and said second piston assembly to allow working fluid to flow from said center assembly to said first piston assembly and said second piston assembly; and wherein said center assembly includes two inlet ports on each of said first end wall and said second end wall, said two inlet ports connected to said first and second compression chambers to allow working fluid to flow from said respective piston cavities of said first piston assembly and said second piston assembly to said first and second compression chambers.

2. The heat engine of claim 1, wherein said inlet ports and said outlet ports of said center assembly and said first and second compression chambers are one way valves.

3. The heat engine of claim 1, wherein said inlet ports and outlet ports of said first and second piston assemblies are positioned on each of said first and second piston assemblies such that movement said respective piston heads open up and closed off said inlet ports and outlet ports of said first and second piston assemblies in a timed manner to allow proper flow of working fluid.

4. The heat engine of claim 1, wherein said center assembly includes an opening in each end wall of said center assembly to allow said piston shafts to move in and out of said center assembly, and said opening includes a seal which does not allow working fluid to transfer between said center assembly and said respective piston cavities.

5. The heat engine of claim 1, wherein said respective piston heads each include a seal to allow said respective piston heads to move in said respective piston cavities without allowing working fluid to transfer between said respective piston heads.

6. The heat engine of claim 2, wherein said respective burners and said respective piston cavities each share a respective wall to allow heat transfer.

7. The heat engine of claim 3, wherein said respective piston heads each include a seal to allow said respective piston heads to move in said respective piston cavities without allowing working fluid to transfer between said respective piston heads.

8. A heat engine using a working fluid comprising:

a center assembly having a first compression chamber and second compression chamber internally, said center assembly having a main wall, a first end wall, and a second end wall sealing said center assembly;

a first piston assembly seal-ably attached to said first end wall of said center assembly, a second piston assembly seal-ably attached to said second end wall of said center assembly, said first and second piston assemblies each including a burner, piston cavity, piston with piston head and piston shaft, said piston shaft of said first piston assembly interconnected to said piston shaft of said second piston assembly, said burners in contact with said respective piston cavities to provide heat to the working fluid in said respective piston cavities;

a heat exchanger connected to said center assembly by a passage to direct the working fluid via said passage to said center assembly, said heat exchanger connected to said first piston assembly and said second piston assembly to receive the working fluid from said first piston assembly and said second piston assembly, said heat exchanger connected to said burner to direct heated gas to said respective burners for combustion of said heated gas; further including a transmission in said center assembly for performing work that is connected to said piston shafts such that movement of said piston shafts drives said transmission;

wherein said transmission includes a slide gear which interconnects said piston shafts, said slide gear including a gear cavity with gear teeth along inner walls of said gear cavity that are parallel to direction of movement of said piston shafts; wherein said transmission includes a drive shaft gear mounted in said gear cavity to rotate along said gear teeth of said inner walls;

and wherein said transmission includes a drive shaft connected to said drive shaft gear.

9. A heat engine using a working fluid comprising:

a center assembly having a first compression chamber and second compression chamber internally, said center assembly having a main wall, a first end wall, and a second end wall sealing said center assembly;

a first piston assembly seal-ably attached to said first end wall of said center assembly, a second piston assembly seal-ably attached to said second end wall of said center assembly, said first and second piston assemblies each including a burner, piston cavity, piston with piston head and piston shaft, said piston shaft of said first piston assembly interconnected to said piston shaft of said second piston assembly, said burners in contact with said respective piston cavities to provide heat to the working fluid in said respective piston cavities;

a heat exchanger connected to said center assembly by a passage to direct the working fluid via said passage to said center assembly, said heat exchanger connected to said first piston assembly and said second piston assembly to receive the working fluid from said first piston assembly and said second piston assembly, said heat exchanger connected to said burner to direct heated gas to said respective burners for combustion of said heated gas; further including a transmission in said center assembly for performing work that is connected to said piston shafts such that movement of the piston shafts drives said transmission;

wherein said center assembly includes an opening in each end wall of said center assembly to allow said piston shafts to move in and out of said center assembly without allowing working fluid to transfer between said center assembly and said respective piston cavities.

* * * * *